US007677694B2

(12) United States Patent
Inaba et al.

(10) Patent No.: US 7,677,694 B2
(45) Date of Patent: Mar. 16, 2010

(54) IMAGE-FORMING APPARATUS AND IMAGE-FORMING METHOD

(75) Inventors: Moriyoshi Inaba, Tokyo (JP); Kazuo Onodera, Yokohama (JP); Hiroshi Kasayama, Mitaka (JP); Atsushi Miyamoto, Nagareyama (JP); Yuichi Takahashi, chofu (JP)

(73) Assignee: Canon Finetech Inc., Ibaraki (JP)

( * ) Notice: Subject to any disclaimer, the term of this patent is extended or adjusted under 35 U.S.C. 154(b) by 132 days.

(21) Appl. No.: 11/753,569

(22) Filed: May 24, 2007

(65) Prior Publication Data

US 2007/0296747 A1 Dec. 27, 2007

(30) Foreign Application Priority Data

Jun. 27, 2006 (JP) ..... 2006-176695

(51) Int. Cl.
*B41J 2/15* (2006.01)

(52) U.S. Cl. ..... 347/41; 347/12

(58) Field of Classification Search ..... 347/12, 347/15, 40, 43, 41
See application file for complete search history.

(56) References Cited

U.S. PATENT DOCUMENTS 6,003,972 A * 12/1999 Narushima ..... 347/43
6,254,218 B1 * 7/2001 Suzuki et al. ..... 347/43
2002/0071000 A1 * 6/2002 Rezanka ..... 347/42
2003/0090539 A1 * 5/2003 Lahut et al. ..... 347/43

FOREIGN PATENT DOCUMENTS

JP 2005-238556 A 9/2005

* cited by examiner

*Primary Examiner*—Lamson D Nguyen
(74) *Attorney, Agent, or Firm*—patenttm.us

(57) ABSTRACT

An image-forming apparatus is provided which is capable of forming a high-quality image without adverse effect (deterioration in printing precision) which may be caused by a dimensional error in producing ink ejection orifice rows, an error in arranging the ink ejection orifice rows, an error in delivering a recording medium, or a like error. With the apparatus employing six rows of ink ejection orifices, an image is formed by ejecting the ink from the third row of the six ink ejection orifice row numbered in the delivery direction onto a raster line zone L3, ejecting the ink from the fifth row onto a raster line zone L5, ejecting the ink from the sixth row onto a raster line zone L6, ejecting the ink from the fourth row onto a raster line zone L4, ejecting the ink from the second row onto a raster line zone L2, and ejecting the ink from the first row numbered in the recording medium delivery direction onto a raster line zone L1.

26 Claims, 16 Drawing Sheets

Fig. 11

| |
|---|
| L4- Fin (Final raster line formed by head K4) |
| L2- Fin (Final raster line formed by head K2) |
| L1- Fin (Final raster line formed by head K1) |
| L3- Fin (Final raster line formed by head K3) |
| L4- (Fin-1) (Raster line before final formed by head K4) |
| L2- (Fin-1) (Raster line before final formed by head K2) |
| L1- (Fin-1) (Raster line before final formed by head K1) |
| L3- (Fin-1) (Raster line before final formed by head K3) |
| L4-(Fin-2) (Second raster line before final formed by head K4) |
| ⋮ |
| L1-4 (Fourth raster line formed by head K1) |
| L3-3 (Third raster line formed by head K3) |
| L4-3 (Third raster line formed by head K4) |
| L2-3 (Third raster line formed by head K2) |
| L1-3 (Third raster line formed by head K1) |
| L3-2 (Second raster line formed by head K3) |
| L4-2 (Second raster line formed by head K4) |
| L2-2 (Second raster line formed by head K2) |
| L1-2 (Second raster line formed by head K1) |
| L3-1 (First raster line formed by head K3) |
| L4-1 (First raster line formed by head K4) |
| L2-1 (First raster line formed by head K2) |
| L1-1 (First raster line formed by head K1) |

RASTER LINES DATA OF IMAGE IN IMAGE MEMORY

IMAGE-FORMING APPARATUS AND IMAGE-FORMING METHOD

TECHNICAL FIELD

The present invention relates to an image-forming apparatus which forms an image by ejecting an ink through plural ink ejection orifices, and to an image-forming method employing the image-forming apparatus.

BACKGROUND TECHNIQUE

Image-forming apparatuses such as ink-jet printers are widely used. The ink-jet printer ejects an ink (ink droplets) through plural ink ejection orifices (nozzle outlets) provided on a printing head. By a known technique for ejecting an ink through ink nozzles, a thermal energy is applied to an ink in a nozzle in accordance with a driving pulse to cause film boiling of the ink, and the ink is ejected from the nozzle by a bubble formed by the boiling. Many ink droplets are ejected through the nozzle onto a recording medium corresponding to the image to be formed.

For increasing the image recording speed (image-forming speed), some of the ink-jet printers employing the above technique have line heads having multiple ink ejection nozzles respectively and placed perpendicularly to the delivery direction of the recording medium, and the ink is ejected simultaneously the ink ejection orifices (line printer: ref. e.g., Japanese Patent Application Laid-Open No. 2005-238556).

The image-forming apparatuses for forming an image on a recording medium are required to be capable of forming the image in high quality with a high resolution. The aforementioned line printers and the like ink-jet printers can satisfy the requirements. The ink-jet printers do not bring the printing heads into contact with the recording medium in printing to enable stable image recording, advantageously.

Mostly, the above line printer employs a printing head which has ink ejection orifices arranged parallel perpendicularly to the direction of the recording medium delivery. Image formation with plural printing heads, six heads as an example, arranged along the direction of the recording medium delivery is described with reference to FIGS. 15A and 15B and FIGS. 16A and 16B.

FIGS. 15A illustrates schematically six line-printing heads K1, K2, K3, K4, K5, and K6 arranged parallel perpendicularly to the recording medium delivery direction (arrow-A direction). FIG. 15B illustrates schematically a printed image having an undesired black stripe. FIG. 16A illustrates schematically six line-printing heads K1, K2, K3, K4, K5, and K6 arranged parallel perpendicularly to the recording medium delivery direction (arrow-A direction). FIG. 16B illustrates schematically a printed image having an undesired white stripe and an indent which are caused by oblique delivery of the recording medium. Here, the six printing heads are arranged in the order of K1, K2, K3, K4, K5, and K6 from the upstream side of the recording medium delivery, and are assumed to conduct printing in this order. In FIG. 15A and FIG. 16A, the numbered circles denote respectively an ink ejection orifice, the number denoting the arrangement order number of the printing heads. In FIG. 15B and FIG. 16B, the numbered circles denote respectively a picture element formed by the ink droplets ejected from the ejection orifices of the printing heads of that order numbers. The two-dot chain lines on the recording medium P denotes raster line zones mentioned later.

After one cycle of printing with printing heads K1-K6 in this order, the next printing cycle is repeated successively.

During the time between the printing by K6 and the next printing by K1, the recording medium is delivered by the distance corresponding to the positional interval between the printing heads K1 and K6. Since the timing of the printing by K1-K6 (ink ejection timing) can be adjusted by confirming the printed image on the recording medium, various methods are disclosed for correcting the error caused by the printing head.

In the printing as described above, further increase of the image-forming speed can cause positional deviation between the print zone with the printing head K1 and the print zone with the printing head K6 to lower the image quality owing to decline of accuracy in the delivery of the recording medium. That is, further increase of the speed of delivery of the recording medium to increase further the image formation speed will make significant the positional deviation of the picture elements in the delivery direction. The ink droplets ejected from printing head K1 can partly overlap with the ink droplets ejected from the printing head K6 to give rise to a black stripe as shown in FIG. 15B by the following causes: (a) variation in the speed of the delivery belt owing to decentering of the driving roller in the perimeter direction; (b) variation in the speed of delivery belt owing to slippage between the driving roller and the delivery belt; (c) variation in the sheet-delivery speed owing to floating of the recording medium; and (d) variation in the sheet-delivery speed owing to slippage between the recording medium and the delivery belt.

Further, the recording medium P can be delivered obliquely (in the direction shown by two-dot chain line arrow in FIG. 16B: the intended delivery direction being shown by the full line arrow A) to cause deviation in the delivery direction from the intended direction by the following causes: (e) difference in the delivery speed of the recording medium between the both side ends in the breadth direction (in particular when the delivery speed is not constant), and (f) snaky movement of the delivery belt; and so forth. The deviation induced by the above causes prevents precise printing at the intended print position. When the position of the recording medium deviates abruptly, an indent L of the print perpendicular to the delivery direction, or a white stripe will be caused abruptly between a zone printed by the printing head K1 and an adjacent zone printed by the printing head K6 as illustrated in FIG. 16B to lower the image quality.

DISCLOSURE OF THE INVENTION

The present invention intends to provide an image-forming apparatus which does not cause a decline of the image quality (printing precision) from an error in delivery of the recording medium, or a like error. The present invention intends also to provide an image-forming method employing the apparatus.

A first embodiment of the image-forming apparatus of the present invention has plural rows of ink ejection orifices arranged parallel perpendicularly to the delivery direction of the recording medium, and forms an image on a recording medium by ejecting an ink successively through a row of ink ejection orifices selected from the plural rows of ink ejection orifices onto one of raster line zones constituted of plural picture element domains arranged, on the recording medium, parallel perpendicularly to the delivery direction of the recording medium, wherein (1) onto two raster line zones adjacent to both sides of the raster line zone onto which the ink is ejected from orifices of the front row of the ink ejection orifices in the delivery direction of the recording medium, the ink is ejected from rows of orifices other than the rearmost row of ink ejection orifices in the delivery direction of the recording medium.

A second embodiment of the image-forming apparatus of the present invention has plural rows of ink ejection orifices arranged parallel perpendicularly to the delivery direction of the recording medium, and forms an image on a recording medium by ejecting an ink successively through a row of ink ejection orifices selected from the plural rows of ink ejection orifices onto one of raster line zones constituted of plural picture element domains arranged, on the recording medium, parallel perpendicularly to the delivery direction of the recording medium, wherein (2) onto raster line zones adjacent to both sides of the raster line zone onto which the ink is ejected from orifices of the selected row of the ink ejection orifices, the ink is ejected from an ink ejection orifice row adjacent to the selected ink ejection orifice row, or from an ejection orifice row next to the above ink-ejection orifice row adjacent to the selected ink ejection orifice row.

A third embodiment of the image-forming apparatus of the present invention has plural rows of ink ejection orifices arranged parallel perpendicularly to the delivery direction of the recording medium, and forms an image on a recording medium by ejecting an ink successively through a row of ink ejection orifices selected from the plural rows of ink ejection orifices onto one of raster line zones constituted of plural picture element domains arranged, on the recording medium, parallel perpendicularly to the delivery direction of the recording medium, wherein (3) the ink is ejected, onto the raster line zones arranged in the delivery direction, successively from the ink ejection orifices of the odd-numbered rows in the delivery direction in the number-ascending order, and onto the following raster line zones, the ink is ejected from the ink ejection orifices of the even-numbered rows in the delivery direction in the number-descending order.

A fourth embodiment of the image-forming apparatus of the present invention has six ink ejection orifice rows arranged parallel perpendicularly to the delivery direction of the recording medium, and forms an image on a recording medium by ejecting successively an ink, through a row of ink ejection orifices selected from the six ejection orifice rows arranged parallel perpendicularly to the delivery direction of the recording medium, onto one of raster line zones constituted of plural picture element domains arranged, on the recording medium, parallel perpendicularly to the delivery direction of the recording medium, wherein (4) the ink is ejected from the third row of the six ink ejection orifice rows numbered in the delivery direction onto an adjacent raster line zone next to the raster line zone onto which the ink is ejected from the front row (first row) numbered in the delivery direction of the ink ejection orifices;

(5) the ink is ejected from the fifth row of the six ink ejection orifice rows numbered in the delivery direction onto an adjacent raster line zone next to the raster line zone onto which the ink is ejected from the third row numbered in the delivery direction of the ink ejection orifices;

(6) the ink is ejected from the sixth row of the six ink ejection orifice rows numbered in the delivery direction onto an adjacent raster line zone next to the raster line zone onto which the ink is ejected from the fifth row numbered in the delivery direction of the ink ejection orifices;

(7) the ink is ejected from the fourth row of the six ink ejection orifice rows numbered in the delivery direction onto an adjacent raster line zone next to the raster line zone onto which the ink is ejected from the sixth row numbered in the delivery direction of the ink ejection orifices;

(8) the ink is ejected from the second row of the six ink ejection orifice rows numbered in the delivery direction onto an adjacent raster line zone next to the raster line zone onto which the ink is ejected from the fourth row numbered in the delivery direction of the ink ejection orifices; and (9) the ink is ejected from the first row of the six ink ejection orifice rows numbered in the delivery direction onto an adjacent raster line zone next to the raster line zone onto which the ink is ejected from the second row numbered in the delivery direction of the ink ejection orifices.

A fifth embodiment of the image-forming apparatus of the present invention has four ink ejection orifice rows arranged parallel perpendicularly to the delivery direction of the recording medium, and forms an image on a recording medium by ejecting successively an ink, through a row of ink ejection orifices selected from the four ejection orifice rows arranged parallel perpendicularly to the delivery direction of the recording medium, onto one of raster line zones constituted of plural picture element domains arranged, on the recording medium, parallel perpendicularly to the delivery direction of the recording medium, wherein

(10) the ink is ejected from the second row of the four ink ejection orifice rows numbered in the delivery direction onto an adjacent raster line zone next to the raster line zone onto which the ink is ejected from the front row (first row) numbered in the delivery direction of the ink ejection orifices;

(11) the ink is ejected from the fourth row of the four ink ejection orifice rows numbered in the delivery direction onto an adjacent raster line zone next to the raster line zone onto which the ink is ejected from the second row numbered in the delivery direction of the ink ejection orifices;

(12) the ink is ejected from the third row of the four ink ejection orifice rows numbered in the delivery direction onto an adjacent raster line zone next to the raster line zone onto which the ink is ejected from the fourth row numbered in the delivery direction of the ink ejection orifices; and

(13) the ink is ejected from the first row of the four ink ejection orifice rows numbered in the delivery direction onto an adjacent raster line zone next to the raster line zone onto which the ink is ejected from the third row numbered in the delivery direction of the ink ejection orifices.

(14) The image-forming apparatus of the above embodiments may eject the same color ink from the plural rows of ink ejection orifices.

(15) The image-forming apparatus of the above embodiments may have the plural rows of the ink ejection orifices on one printing head.

(16) The image-forming apparatus of the above embodiments may have the rows of the plural ink ejection orifices respectively on separate printing heads.

A first embodiment of the image-forming method of the present invention serves to form an image on a recording medium by ejecting an ink successively through a row of ink ejection orifices selected from plural rows of ink ejection orifices arranged parallel perpendicularly to the delivery direction of the recording medium onto one of raster line zones constituted of plural picture element domains arranged, on the recording medium parallel perpendicularly to the delivery direction of the recording medium, wherein

(17) onto two raster line zones adjacent to both sides of the raster line zone onto which the ink is ejected from orifices of the front row of ink ejection orifices in the delivery direction of the recording medium, the ink is ejected from rows of orifices other than the rearmost row of the ink ejection orifices in the delivery direction of the recording medium.

A second method embodiment of the image-forming method of the present invention serves to form an image on a recording medium by ejecting an ink successively through a row of ink ejection orifices selected from plural rows of ink ejection orifices arranged parallel perpendicularly to the delivery direction of the recording medium onto one of raster line zones constituted of plural picture element domains arranged, on the recording medium, parallel perpendicularly to the delivery direction of the recording medium, wherein

(18) onto raster line zones adjacent to both sides of the raster line zone onto which the ink is ejected from orifices of the selected row of the ink ejection orifices, the ink is ejected from an ink ejection orifice row adjacent to the selected ink ejection orifice row, or from an ejection orifice row next to the ink-ejection orifice row adjacent to the selected ink ejection orifice row.

A third embodiment of the image-forming method of the present invention serves to form an image on a recording medium by ejecting an ink successively through a row of ink ejection orifices selected from plural rows of ink ejection orifices arranged parallel perpendicularly to the delivery direction of the recording medium onto one of raster line zones constituted of plural picture element domains arranged, on the recording medium, parallel perpendicularly to the delivery direction of the recording medium, wherein

(19) the ink is ejected, onto the raster line zones arranged in the delivery direction, successively from the ink ejection orifices of the odd-numbered rows in the delivery direction in the number-ascending order, and onto the succeeding raster line zones, the ink is ejected from the ink ejection orifices of the even-numbered rows in the delivery direction in the number-descending order.

A fourth embodiment of the image-forming method of the present invention serves to form an image on a recording medium by ejecting successively an ink through a row of ink ejection orifices selected from six ink ejection orifice rows arranged parallel perpendicularly to the delivery direction of the recording medium, onto one of raster line zones constituted of plural picture element domains arranged parallel perpendicularly to the delivery direction of the recording medium. This method conducts simultaneously steps of:

(20) ejection of the ink from the third row of the six ink ejection orifice rows numbered in the delivery direction onto an adjacent raster line zone next to the raster line zone onto which the ink is ejected from the front row (first row) numbered in the delivery direction of the ink ejection orifices;

(21) ejection of the ink from the fifth row of the six ink ejection orifice rows numbered in the delivery direction onto an adjacent raster line zone next to the raster line zone onto which the ink is ejected from the third row numbered in the delivery direction of the ink ejection orifices;

(22) ejection of the ink from the sixth row of the six ink ejection orifice rows numbered in the delivery direction onto an adjacent raster line zone next to the raster line zone onto which the ink is ejected from the fifth row numbered in the delivery direction of the ink ejection orifices;

(23) ejection of the ink from the fourth row of the six ink ejection orifice rows numbered in the delivery direction onto an adjacent raster line zone next to the raster line zone onto which the ink is ejected from the sixth row numbered in the delivery direction of the ink ejection orifices;

(24) ejection of the ink from the second row of the six ink ejection orifice rows numbered in the delivery direction onto an adjacent raster line zone next to the raster line zone onto which the ink is ejected from the fourth row numbered in the delivery direction of the ink ejection orifices; and

(25) ejection of the ink from the first row of the six ink ejection orifice rows numbered in the delivery direction onto an adjacent raster line zone next to the raster line zone onto which the ink is ejected from the second row numbered in the delivery direction of the ink ejection orifices.

A fifth embodiment of the image-forming method of the present invention serves to form an image on a recording medium by ejecting successively an ink through a row of ink ejection orifices selected from four ink ejection orifice rows arranged parallel perpendicularly to the delivery direction of the recording medium, onto one of raster line zones constituted of plural picture element domains arranged parallel perpendicularly to the delivery direction of the recording medium. This method conducts simultaneously steps of:

(26) ejection of the ink from the second row of the four ink ejection orifice rows numbered in the delivery direction onto an adjacent raster line zone next to the raster line zone onto which the ink is ejected from the front row (first row) numbered in the delivery direction of the ink ejection orifices;

(27) ejection of the ink from the fourth row of the four ink ejection orifice rows numbered in the delivery direction onto an adjacent raster line zone next to the raster line zone onto which the ink is ejected from the second row numbered in the delivery direction of the ink ejection orifices;

(28) ejection of the ink from the third row of the four ink ejection orifice rows numbered in the delivery direction onto an adjacent raster line zone next to the raster line zone onto which the ink is ejected from the fourth row numbered in the delivery direction of the ink ejection orifices; and

(29) ejection of the ink from the first row of the four ink ejection orifice rows numbered in the delivery direction onto an adjacent raster line zone next to the raster line zone onto which the ink is ejected from the third row numbered in the delivery direction of the ink ejection orifices.

(30) In the above embodiments of the image-forming method, the same color ink may be ejected from the plural rows of ink ejection orifices.

(31) In the above embodiments of the image-forming method, the ink ejection orifices may be provided in plural rows on one printing head.

(32) In the above embodiments of the image-forming method, the plural ink ejection orifices may be provided in a row respectively on separate printing heads.

A still another embodiment of the image-forming apparatus has plural rows of image-forming elements arranged parallel perpendicularly to the delivery direction of the recording medium, and forms an image on a recording medium successively a portion of an image, with a row of the image-forming elements selected from the plural rows of image-forming elements arranged parallel perpendicularly to the delivery direction of the recording medium, on one of raster line zones constituted of plural picture element domains arranged, on the recording medium, parallel perpendicularly to the delivery direction of the recording medium, wherein

(33) onto two raster line zones adjacent to both sides of the raster line zone onto which the a portion of the image is formed by a front row of the image-forming elements in the delivery direction of the recording medium, the portion of the image is formed by a row of the image-forming elements other than the rearmost row of the image-forming elements in the delivery direction.

A still another embodiment of the image-forming method of the present invention serves to form an image on a recording medium by forming successively a portion of an image, with a row of image-forming elements selected from plural rows of image-forming elements arranged parallel perpendicularly to a delivery direction of the recording medium, on one of raster line zones constituted of plural picture element domains arranged, on the recording medium, parallel perpendicularly to the delivery direction of the recording medium, wherein

(34) onto two raster line zones adjacent to both sides of the raster line zone onto which the a portion of the image is formed by a front row of the image-forming elements in the delivery direction of the recording medium, the portion of the image is formed by a row of the image-forming elements other than the rearmost row of the image-forming elements in the delivery direction.

The term "image-forming element" herein includes an ink ejection orifice on a printing head in an ink-jet type of image-forming apparatus, and a heater element on a printing head of a thermal transfer type image-forming apparatus.

In the present invention, onto two raster line zones adjacent to the front and rear sides of the raster line zone in the delivery direction onto which the ink is ejected from orifices of the first row of the ink ejection orifices in the delivery direction of the recording medium, the ink is ejected from rows of orifices other than the rearmost row of ink ejection orifices in the delivery direction of the recording medium. In the case where no error is caused in production or the image-forming apparatus or in delivery of the recording medium, the ink ejected from the plural ink ejection orifice rows can impact the designed positions without lowering the printing precision (image quality) even if the speed of delivery of the recording medium is high. Actually, however, some errors can arise in operations such as delivery of the recording medium, which may cause an error in impact position of the ink droplets ejected from plural rows of ink ejection orifices. Since among the ink ejection orifice rows, the front row and the rearmost row of the ink ejection orifices are farthest in distance, the possibility is high that the deviation between the impact positions of the ink droplets ejected from the front and rearmost rows may cause a larger error. However, as described above, onto two raster line zones adjacent to the front and rear sides of the raster line zone in the delivery direction onto which the ink is ejected from orifices of the front row of the ink ejection orifices in the delivery direction of the recording medium, the ink is not ejected from the rearmost row of ink ejection orifices in the delivery direction of the recording medium, whereby the above error (deviation) can be prevented. Therefore, the decline of the image quality (printing precision) owing to the error in delivery of the recording medium can be prevented.

BRIEF DESCRIPTION OF THE DRAWINGS

FIG. 11 is a schematic view of an image data saved in an image memory.

FIG. 13A is a schematic view of six printing heads K1, K2, K3, K4, K5, and K6 placed in the recording medium delivery direction; and FIG. 13B is a schematic view of an image which is prevented from decline of the image quality.

BEST MODE FOR CARYING OUT THE INVENTION

The present invention has been realized in a line printer which ejects the same color of ink through plural printing heads.

EXAMPLE 1

Figure 1:
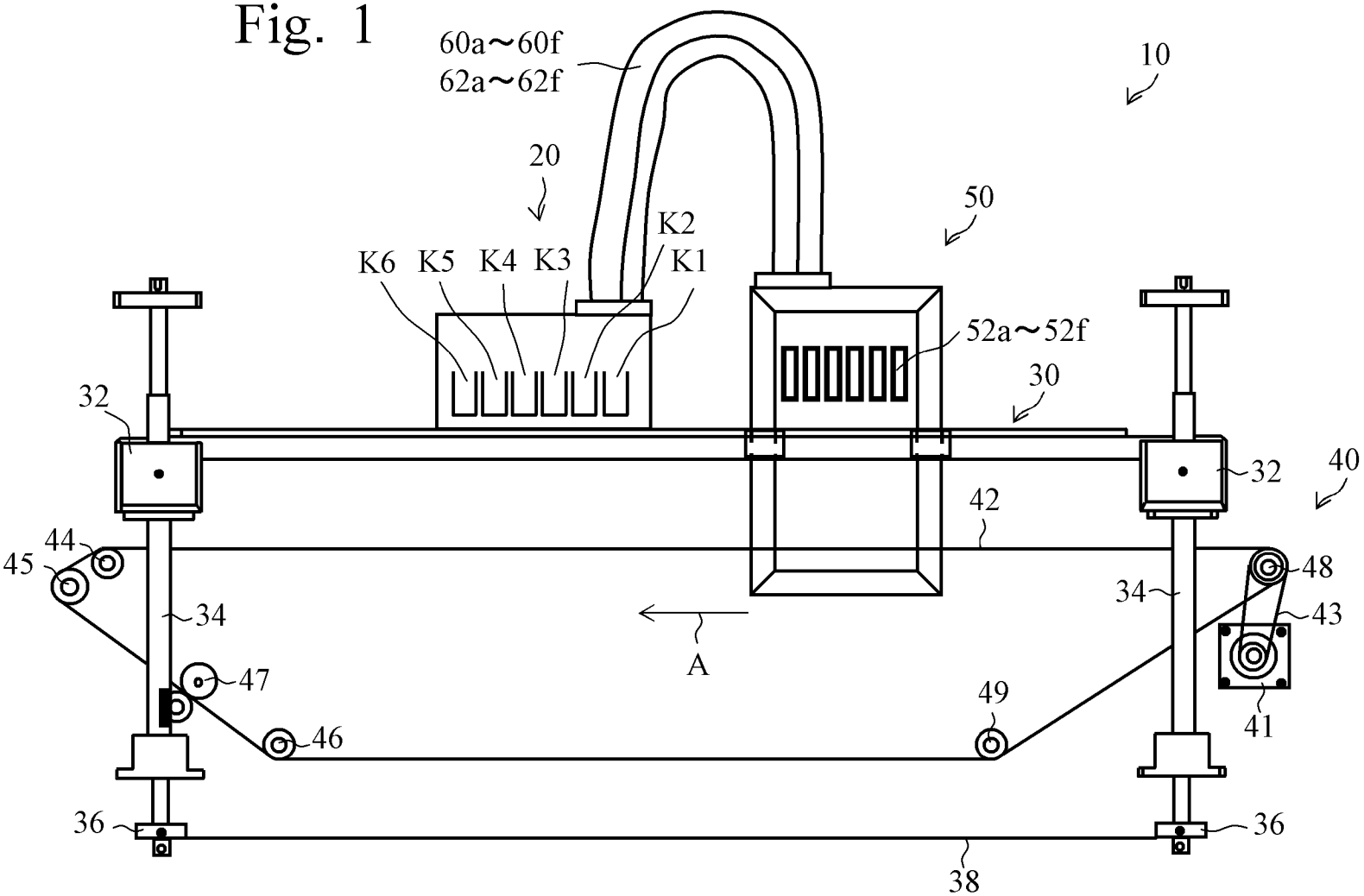
FIG. 1 is a schematic front view of a line printer incorporating a print module which is an example of the image-forming apparatus of the present invention.
Figure 2:
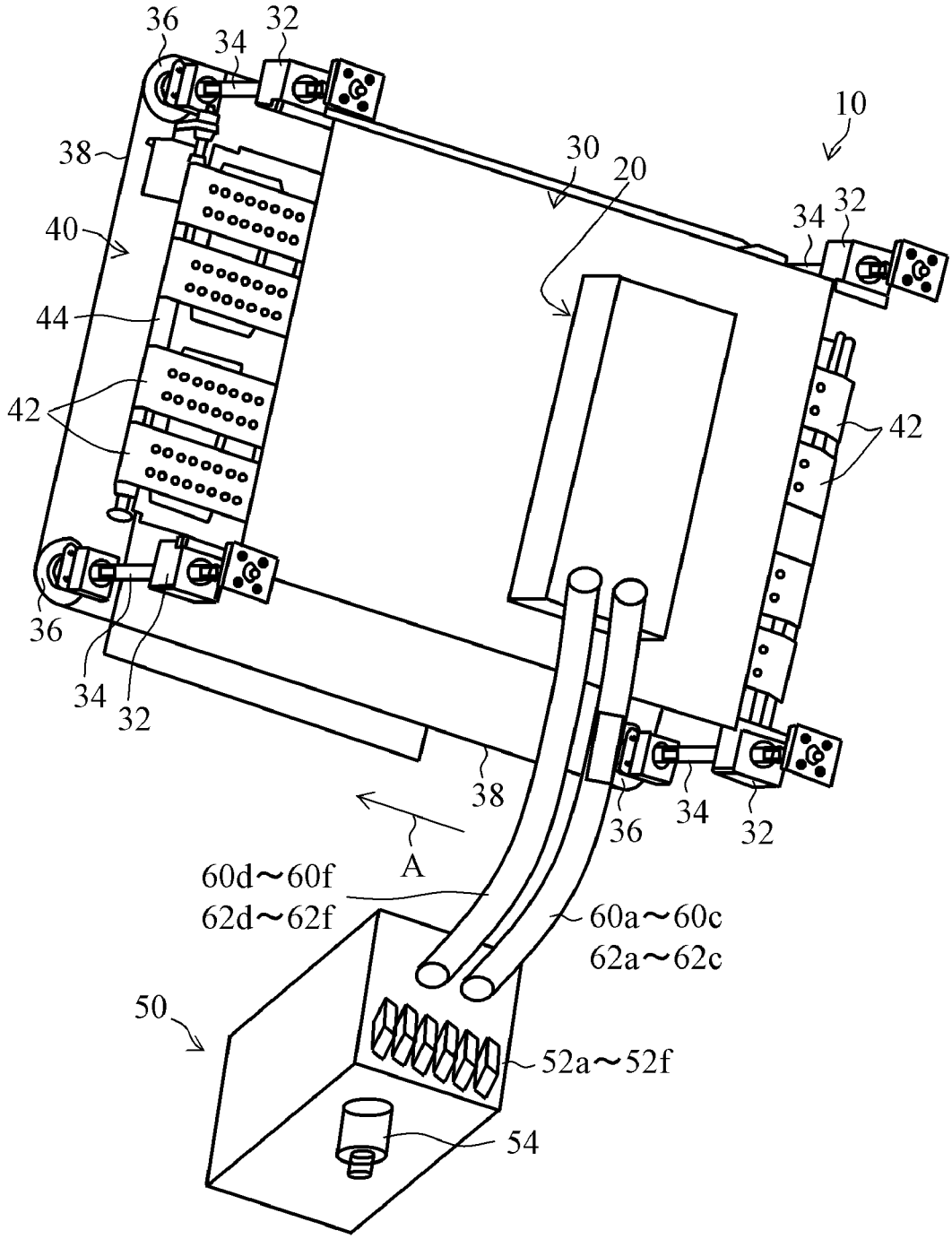
FIG. 2 is a schematic perspective view of the line printer illustrated in FIG. 1.

A skeleton of a line printer incorporating a printing module (printing unit), an example of the image-forming apparatus of the present invention, is described briefly with reference to FIG. 1 and FIG. 2.

FIG. 1 is a schematic front view of a line printer incorporating a print module which is an example of the image-forming apparatus of the present invention. FIG. 2 is a schematic perspective view of the line printer illustrated in FIG. 1.

The line printer 10 has a printing head unit 20 and a delivery unit 40: the printing unit 20 has printing heads K1, K2, K3, K4, K5, and K6, for ejecting an ink on a recording medium like a recording paper sheet for forming an image; and the delivery unit 40 delivers a recording medium in an arrow-A direction (recording medium delivery direction). From all of the printing heads K1, K2, K3, K4, K5, and K6, a black ink is ejected. The printing head unit 20 has a head-driving motor 118 (FIG. 5) for moving the printing heads K1-K6 to a capping position, a printing position, and a wiping position. The printing head unit 20 is fixed to an engine base 30, and is moved vertically together with the engine base 30 as described later.

The engine base 30 which holds the printing unit 20 thereon is rectangular, and four corners thereof are fixed to nuts 32. The nuts 32 are fit to screwed axes 34. The nuts 32 are moved vertically by rotating the four screwed axes 34. At the lower portion of the respective screwed axes 34, a sprocket 36 is fixed. The four sprockets 36 are connected by a chain 38.

The motor 41 is driven to circulate the chain 38 to rotate the screw axes 34 synchronously, whereby the printing head unit 20 is vertically moved together with the engine base 30.

The delivery unit 40 has four delivery belts 42 for delivering a recording medium through under the printing head unit 20. The delivery belts 42 are stretched around the driven rollers 44,45,46, the encoder roller 47, and the driving roller 48 with application of a tension by a tensioner 49. These delivery belts 42 are circulated in the direction of the recording medium delivery (arrow-A direction) by a driving roller 48 driven by a timing belt 43 driven by a driving motor 41.

The line printer 10 has an ink-feeding unit 50 to feed an ink to the printing head 20. The ink-feeding unit 50 has therein subsidiary tanks 52*a*-52*f* (hereinafter referred to as "sub-tanks") for storing the ink to be fed to the printing heads K1-K6, and ink tanks 53*a*, etc. (FIG. 4) for storing the ink to be supplied to the sub-tanks 52*a*-52*f*. The ink stored in the sub-tank 52*a* is fed to the printing head K1; the ink stored in the sub-tank 52*b* is fed to the printing head K2; and so forth. The ink tanks are connected respectively through tubes 56 (FIG. 4) to the sub-tanks 52*a*-52*f* to feed the ink from the ink tanks 53*a*, etc. to the sub-tank 52*a*, etc. The ink-feeding unit 50 and the printing head unit 20 are connected detachably by ink flow paths constituted from a bundle of ink-feeding tubes 60*a*-60*f* and ink-returning tubes 62*a*-62*f*. The ink is fed from the sub-tanks 52*a*-52*f* through the ink-feeding tubes 60*a*-60*f* to the printing head K1-K6, and the ink is allowed to return from the printing heads K1-K6 through the ink-recovering tubes 62*a*-62*f* to the sub-tanks 52*a*-52*f*. The printing head unit 20 incorporates a recovery unit 22 (FIG. 4) for recovering the initial ink ejection performance of the printing heads K1-K6.

The connection of the printing head unit 20 with the ink-feeding unit 50 is described below with reference to FIG. 3.

Figure 3:
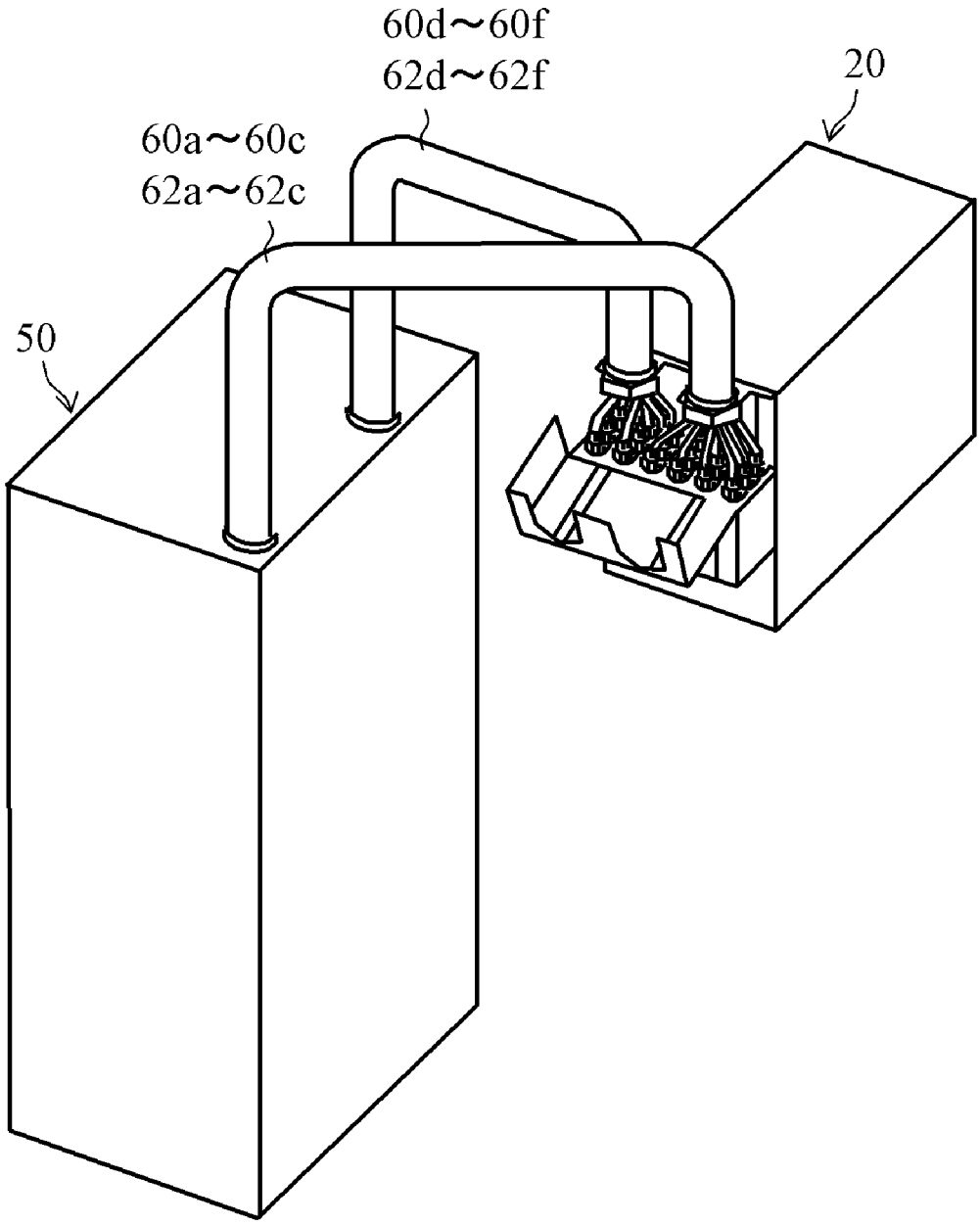
FIG. 3 is a perspective view illustrating an ink-feeding tube and ink-returning tube connecting the printing head with the ink-feeding unit.

FIG. 3 is a perspective view illustrating an ink-feeding tube and an ink-recovering tube for connecting the printing head with the ink-feeding unit.

The combination of the printing head unit 20 with the ink-feeding unit 50 connected by the tubes is called "a print module". This print module 20 incorporates a control system described later with reference to FIG. 5. The printing head unit 20 has printing heads K1-K6 (FIG. 1). The respective printing heads K1-K6 have the ink ejection orifices arranged in parallel rows perpendicular to the recording medium delivery direction (arrow-A direction in FIG. 1) in a breadth corresponding to the image recording area. In formation of an image, the respective printing heads K1-K6 eject a black ink successively from upstream side of the recording medium delivery direction (upstream side of the arrow-A direction). The ink-feeding unit 50 is placed separately from the printing head unit 20. The sub-tanks 52*a*-52*f* of the ink-feeding unit 50 are respectively connected with the printing heads K1-K6 of the printing head unit 20 by the ink-feeding tube 60*a*-60*f* and the ink-returning tubes 62*a*-62*f*.

The ink flow paths in and between the printing head 20 and the ink-feeding unit 50 are described with reference to FIG. 4.

Figure 4:
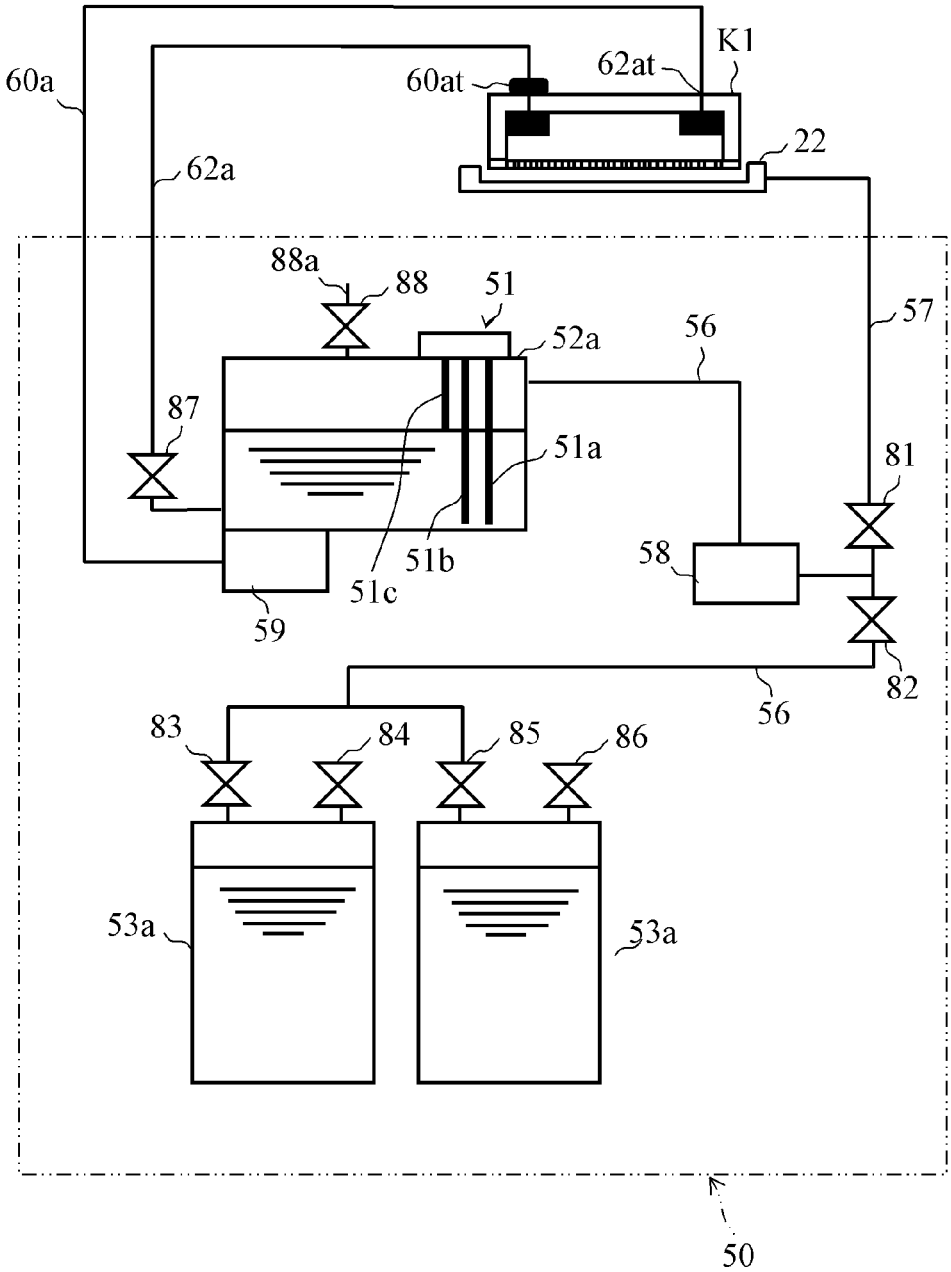
FIG. 4 illustrates schematically ink flow paths in a printing head unit and an ink-feeding unit.

FIG. 4 illustrates schematically ink flow paths in the printing head unit and the ink-feeding unit. Here, the printing head K1 and sub-tank 52*a* are taken as an example: other printing heads K2-K6 are the same.

The ink tank 53*a* storing a black ink is connected by an ink-sucking tube 56 to the sub-tank 52*a*. A suction pump 58 is placed in the flow path of the ink-sucking tube 56 for sucking the ink from the ink tank 53*a* and feeds the ink to the sub-tank 52*a*. As illustrated in FIG. 4, the ink is sucked from the ink tank 53*a* and is fed to the sub-tank 52*a* by driving the suction pump 58 with the valves 81,85 closed and the valves 82,83,84 opened. In order to prevent failure of ink feeding, the ink tanks 53*a* are provided in a pair. When the ink in one of the ink tanks 53*a* has been used up, the suction tube 56 is switched to the other ink tank 53*a* by controlling suitably the valves 83,84,85,86.

The sub-tank 52*a* is connected to an air communication hole 88*a*, and the inside pressure can be equalized to an atmospheric pressure by opening the valve 88. The sub-tank 52*a* is provided with an ink level sensor (liquid level detection sensor) 51 having an electrodes 51*a*,51*b*,51*c* for sensing the presence of the ink and the liquid level of the ink. By sensing the presence of the ink, the ink surface level can be controlled to be constant. The sub-tank 52*a* and the printing head K1 are placed at positions so as to apply a suitable negative pressure by water head difference to the ink ejection orifice of the printing head K1.

The sub-tank 52*a* is connected to the printing head K1 through the ink-feeding tube 60*a* and the ink-returning tube 62*a* to circulate the ink. An ink-feeding pump 59 is placed between the sub-tank 52*a* and the ink-feeding tube 60*a*. The ink is fed from the sub-tank to the printing head K1 by driving the ink-feeding pump 59. Below the printing head K1, a recovery unit 22 is placed to receive the ink discharged from the printing head K1. The recovery unit 22 and the sub-tank 52*a* are connected with each other through an ink-recovering tube 57 and an ink-sucking tube 56. The ink collected in the recovery unit 22 is recovered to the sub-tank by driving the suction pump 58 with the valve 82 closed and the valve 81 opened.

Next, the initial process for filling an ink from the respective ink tanks 53*a*-53*f* to printing heads K1-K6 is described in the case where a line printer 10 is newly mounted.

The initial ink filling operation is started when the printer 10 has been started up initially. In the initial start-up of the line printer 10, no ink is contained in the sub-tank 52*a*, the ink-sucking tube 56, the ink-feeding tube 60*a*, the ink-recovering tube 62*a*, and the printing head K1. In this initial filling operation, the ink is filled into the sub-tank 52*a*, the ink-feeding tube 60*a*, and the ink-returning tube 62*a*, or only into the sub-tank 52*a*.

To fill the ink into the sub-tank 52*a*, the ink-feeding tube 60*a*, and ink-returning tube 62*a*, the ink-feeding tube 60*a* is disconnected from the printing head K1 before feeding the ink from the sub-tank 52*a* to the printing head K1, and the ink is filled into the sub-tank 52*a* and the ink-feeding tube 60*a* from the main tank 53*a*. Then the ink-feeding tube 60*a* is connected with the printing head K1, and the ink is fed through the ink-feeding tube 60*a* to the printing head K1. After completion of the initial filling operation, the ink adhering to the head face K1*s* is wiped off by a cleaning blade 22*b* as described later.

For filling the ink-feeding tube 60*a* with the ink, the ink-feeding tube 60*a* is disconnected from the printing head K1, the disconnected end 60 at of the ink-feeding tube 60*a* and the end 62 at of the ink-returning tube 62*a* are connected together directly or indirectly, and the ink-feeding pumps 58,59 are driven to circulate the ink through main tank 53*a*, sub-tank 52*a*, the ink-feeding tube 60*a*, and the ink-returning tube 62*a*. Thereby, the ink expels the air from the ink-feeding tube 60*a* to fill the ink-feeding tube 60*a*. Then the ink-feeding tube 60*a* is disconnected from the ink-returning tube 62*a*, and is connected to the printing head K1. The ink is fed from the ink-feeding tube 60*a* to the printing head K1. In such a manner, intrusion of air from the ink-feeding tube 60*a* into the printing head K1 is prevented. This prevents evolution of an air bubble in the printing head K1. Thereby, when the ink is pushed out from the printing head K1 to the cap 22*a*, the ink is not expelled by a large amount of the air bubble not to cause overflow of the ink from the cap 22*a*. As mentioned above, in the initial ink filling operation, the ink may be filled from the ink tank 53*a* into the sub-tank 52*a* only. For this ink feeding, the suction pump 58 is driven with the valves 81 and 87 closed and the valve 82 opened.

The control system 100 of the printer 10 is described with reference to FIG. 5.

Figure 5:
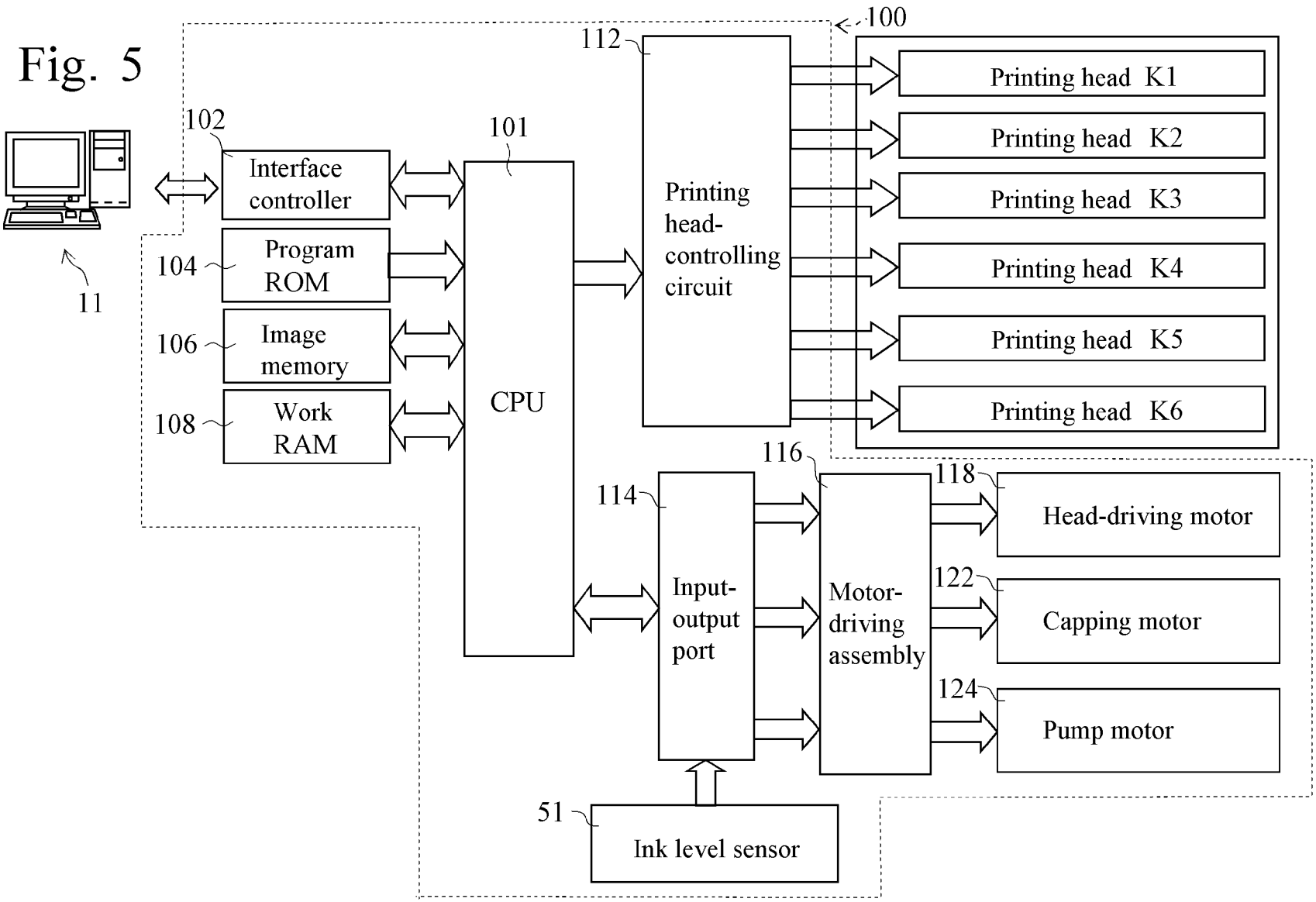
FIG. 5 is a block diagram of the control system of the printer illustrated in FIG. 1.

FIG. 5 is a block diagram of the control system of the printer illustrated in FIG. 1. This control system contained in the print module as mentioned above.

The data or commands for recording are transmitted from a host PC 11 through an interface controller 102 to a CPU 100. The CPU 101 is a processing unit for controlling entirely the operation of the printer 10 such as reception of recording data, and recording of the data. The CPU 101, after analyzing received commands, develops the image data for the respective color as a bit map in the image memory 106 and draw an image. As the operation prior to the recording, a capping motor 122 and a head-driving motor 118 are driven through an output-input port 114 and a motor-driving assembly 116 to move the printing heads K1-K6 respectively to be apart from the cap 22*a* (FIG. 6) to the recording position (image formation position).

Then, the position of the front edge of the recording medium is detected by a front edge-detecting sensor (not shown in the drawing) for determining the timing (recording timing) of ejection of the ink onto the delivered recording medium. Thereafter, the CPU 101 reads out recorded color data from the image memory 106 in synchronization with the delivery of the recording medium according to the output signal successively from the encoder roller 47 (FIG. 1). The read-out data are transmitted through the printing head-controlling circuit 112 to the printing heads K1-K6.

The CPU 101 is operated in accordance with the processing program memorized in a program ROM 104. The program ROM 104 memorizes a processing program and tables corresponding to the control flow. A work RAM 108 is used as the operation memory. In the operation of cleaning and recovery of the respective printing heads K1-K6, the CPU 101 controls ink pressurization and ink sucking by driving a pump motor 124 through an input-output port 114 and a motor-driving assembly 116. An image is formed on a recording medium in accordance with a horizontal synchronization signal for the record in synchronization with the delivery of the recording medium. As described later, the raster is divided by the CPU 101, and the raster divisions are input to the image memory 106 as the image data for image formation with the six recording heads K1-K6. On receiving the horizontal synchronization signal, the CPU 101 transmits one raster division of the image data stored in the image memory 106 to the printing head-controlling circuit 112. In accordance with the transmitted image data, the ink is ejected from the corresponding printing head, as mentioned later.

A process for image formation under control by the above-mentioned control system 100 is described with reference to FIGS. 6-8.

Figure 6:
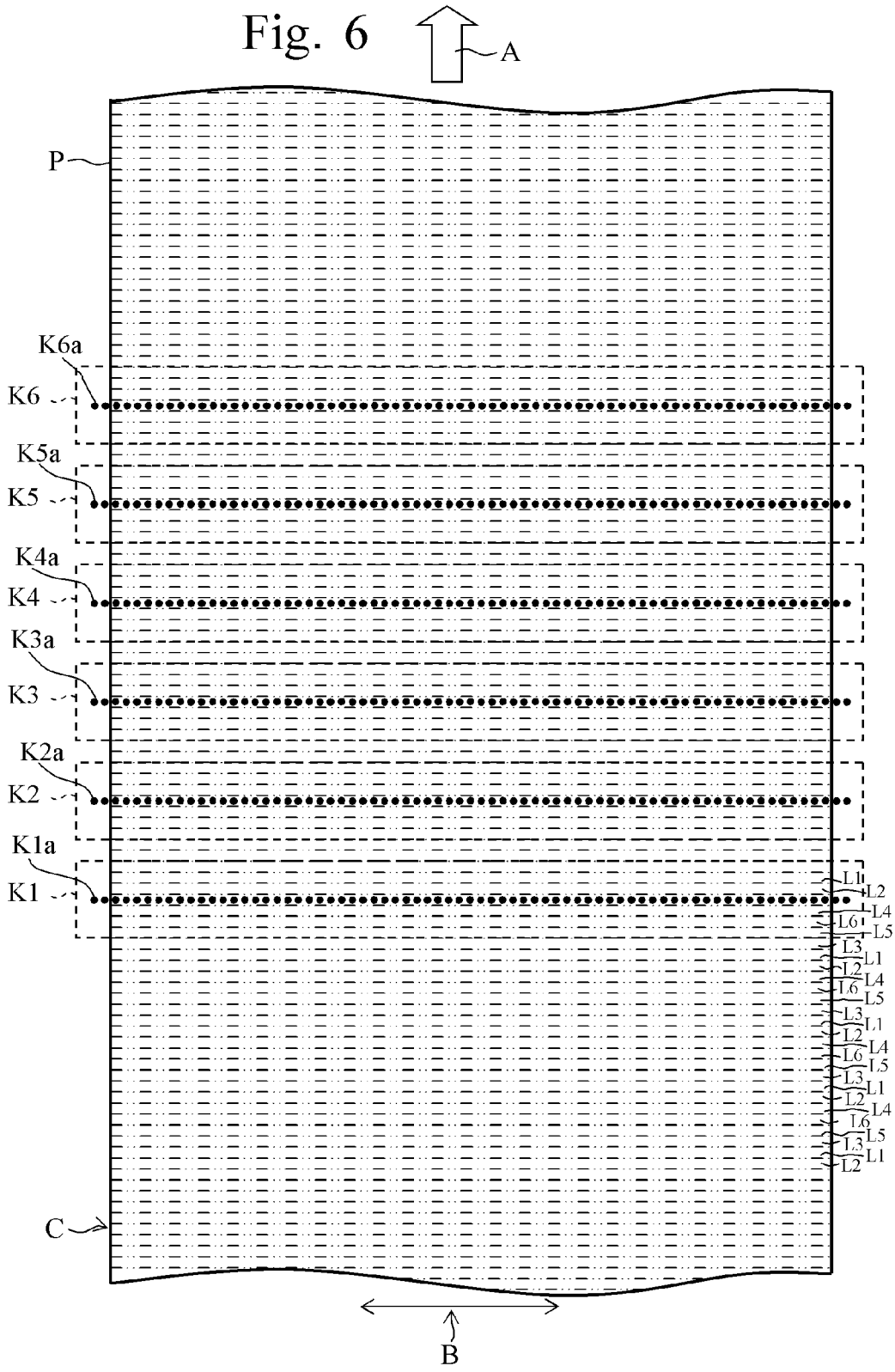
FIG. 6 is a schematic plan view illustrating relative positions of the printing heads and ink ejection orifices placed above the delivery path relative to the delivered recording medium.

FIG. 6 is a schematic plan view illustrating positions of the printing heads and ink ejection orifices placed above the delivery path relative to the delivery of the recording medium. FIG. 7 illustrates schematically an intermediate state of formation of an image on a recording medium. FIG. 8 is an enlarged view of a part of FIG. 7.

A recording medium P (e.g., rolled paper sheet, or cut paper sheet) is delivered in the arrow-A direction by a delivery unit 40 (FIG. 1, etc.). On the face of the recording medium being delivered, raster line zones L1-L6 are assumed which extends to be perpendicular to the recording medium delivery direction (allow-B direction, a crossing direction in the present invention). The raster line zones L1-L6 are arranged adjacently in the recording medium delivery direction. In FIG. 6, an imaginary border line between the adjacent raster line zones (e.g., L5 and L3) is denoted by a two-dot chain line, which is not actually drawn on the recording medium P. Image data of one raster division is transmitted to one raster line zone. In FIGS. 6-8, the raster line zones are shown enlargedly to be visible, although the actual one is extremely fine and is invisible.

The one raster line zone has plural picture element domains aligned in the aforementioned crossing direction (arrow-B direction). The term "picture element" herein denotes an image formed by one ink droplet ejected from one ink ejection orifice. The term "picture element domain" denotes an area (a portion or a range) where one ink droplet ejected from one ink ejection orifice deposits. Onto the one raster line zone, one of the printing heads K1-K6 ejects the ink selectively and simultaneously from a row of plural ink ejection orifices thereof. The printing heads K1-K6 are made preliminarily to correspond respectively to one of the raster line zones L1-L6. Here, the printing head K1 ejects the ink onto the raster line zone L1 to form plural picture elements: the printing head K2 ejects the ink onto the raster line zone L2 to form plural picture elements. Similarly, the printing head K3 corresponds to the raster line zone L3, the printing head K4 corresponds to the raster line zone L4, the printing head K5 corresponds to the raster line zone L5, and the printing head K6 corresponds to the raster line zone L6. When the raster line zone L1 has reached the position directly below the printing head K1, the ink is ejected from the ink ejection orifice row of the printing head K1 toward the raster line zone L1. Similarly when the raster line zone L2 has reached the position directly below the printing head K2, the ink is ejected from the ink ejection orifice row of the printing head K2 toward the raster line zone L1. The ink is ejected similarly onto the raster line zones L3-L6.

Figure 7:
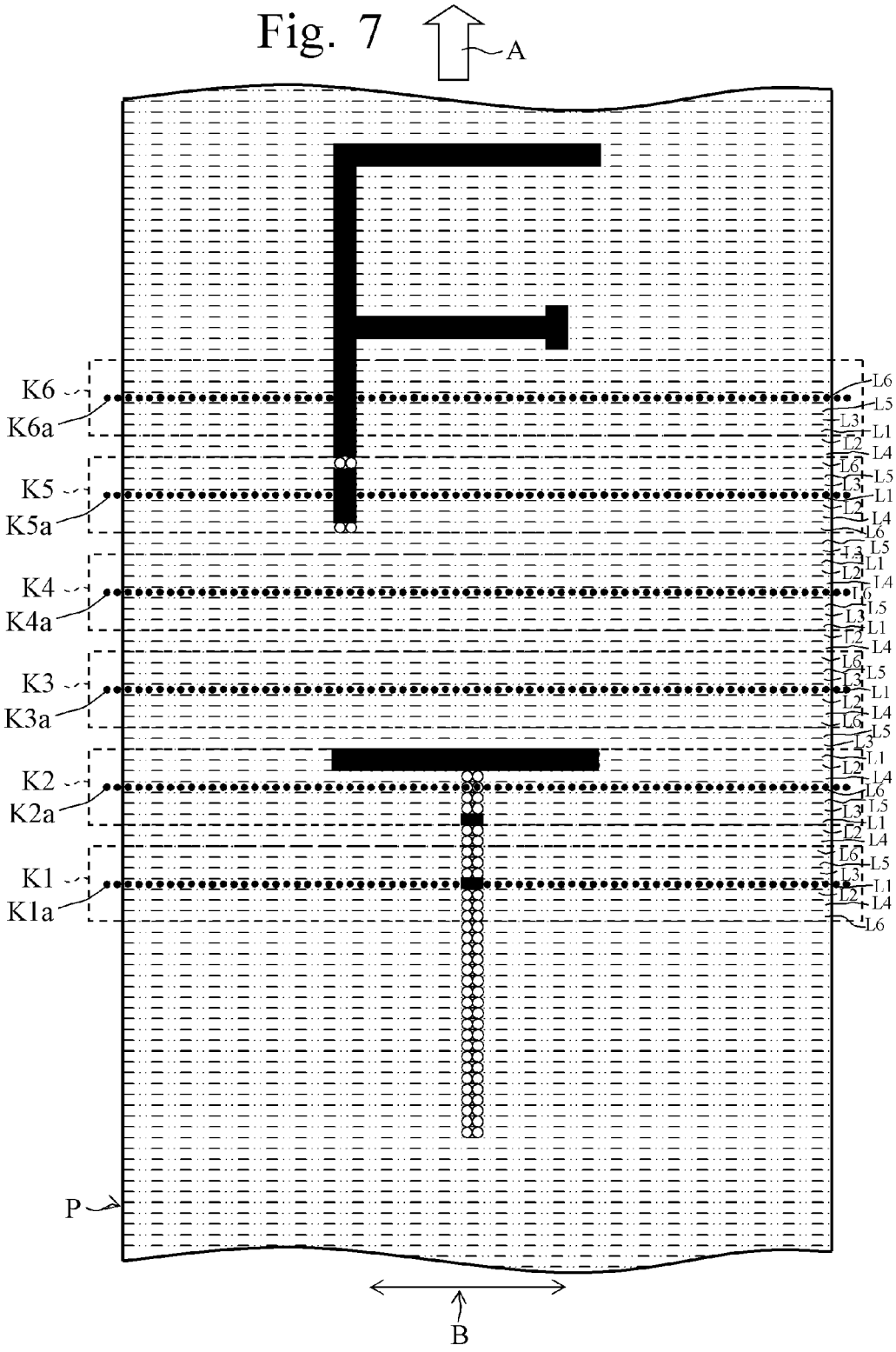
FIG. 7 illustrates schematically an intermediate state of formation of an image on a recording medium.
Figure 8:
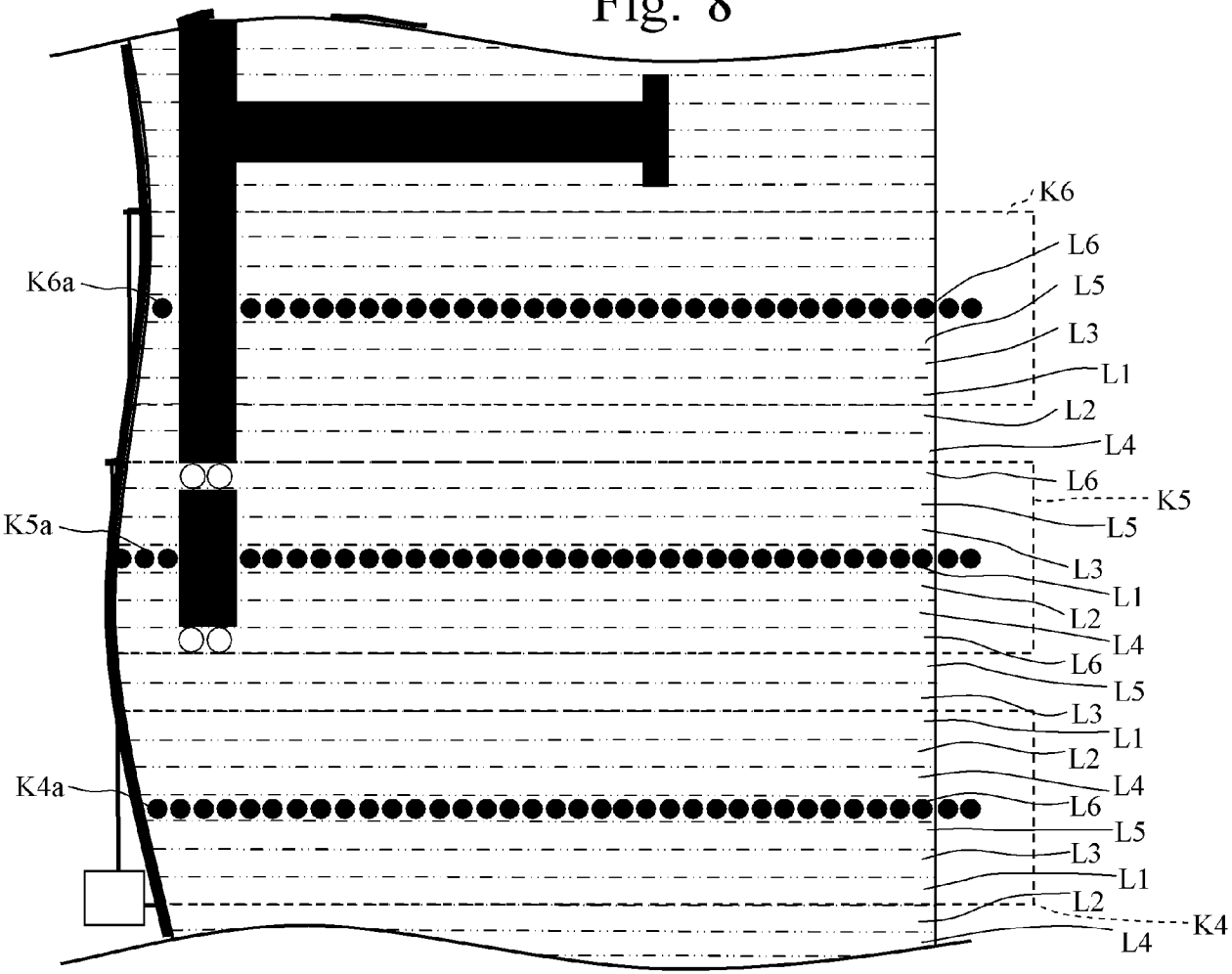
FIG. 8 is an enlarged view of a part of FIG. 7.

The six printing heads K1-K6 of the printer 10 respectively extend in the above-mentioned crossing direction (arrow-B direction) as shown in FIGS. 6 and 7. The printing heads K1-K6 have respectively plural ink ejection orifices arranged in a row in the arrow-B direction to form an ink ejection orifice row. (In the drawings, one ink ejection orifice is denoted by a solid circle denoted by symbols K1*a*, K6*a*, etc.) The ink is ejected from the ink ejection orifices of the ink ejection orifice rows of the printing heads K1-K6 under control by a printing head controlling circuit 112 (FIG. 5) in accordance with an image data. In the above embodiment, one row of ink ejection orifices are provided on one printing head. Otherwise, six rows of the ink ejection orifices may be provided on one printing head, or two rows of the ink ejection orifices may be provided on each of three printing heads.

As described above, image data (print data) for printing (formation) of an image on a recording medium are divided by CPU 101 into raster divisions. The term "raster" herein signifies a pattern of a number of picture elements arranged generally in lateral lines to form an image; in this embodiment the picture elements are arranged in lines in a direction perpendicular to the recording medium delivery direction (the length direction of the printing head). The term "raster division" herein signifies division of the data of a raster constituting the image to correspond to the printing heads K1-K6 for formation of plural picture elements of the raster line by ejection of the ink from the one row of ink ejection orifices. In this embodiment, the raster division is effected by the CPU 101 to input the divided data for printing by the six printing heads K1-K6 to the image memory 106. Otherwise, the image data of the raster may be divided into raster divisions by a driver (not shown in the drawing) of the host PC 11 or the like, and transmitted to the printer 10.

FIG. 7 illustrates formation of an image of characters "FT" by raster division. The image data of the characters "FT" are divided by the CPU 101 into raster divisions, lines of plural picture elements (one picture element or no picture element in some images), in the arrow-B direction as illustrated in FIG. 7. The respective raster divisions are input into the image memory 106 and made to correspond to one of the printing heads K1-K6. At the timing when one of the imaginary raster line zones L1-L6 has come to the position directly below the corresponding printing heads K1-K6, ink is ejected from the ink ejection orifice row of the corresponding printing head K1-K6. In the state illustrated in FIG. 7, the raster line zone L1 is directly below the printing head K1 (ink ejection orifice row, hereafter the same), and the raster line zone L6 is directly below the printing head K6, which allows the ink ejection from the printing heads K1 and K6. However, in the state illustrated in FIG. 7, the raster line zone L6 is directly below the printing head K2, the raster line zone L1 is directly below the printing head K3, the raster line zone L6 is directly below the printing head K4, and the raster line zone L1 is directly below the printing head K5, so that the ink is not ejected from the printing heads K2, K3, K4, and K5.

With the delivery of the recording medium P in the arrow-A direction, respective raster line zones reach successively the positions directly below the printing heads K1-K6. CPU 101 controls the printing head K1 to eject the ink from the selected ink ejection orifices of the ink ejection orifice row of the printing head K1 at the timing when the raster line zone L1 reaches the position directly below the printing head K1 in accordance with the image data. (The same is true with other printing heads.) As described above, in this embodiment, an image is formed by six rows of ink ejection orifices. In this case, the third row numbered from the upstream front side of the six ink-ejection orifice rows (ink ejection orifice row of the printing head K3) in the delivery direction ejects the ink onto the raster line zone L3 which is adjacent to a raster line zone L1 onto which the ink has been ejected from the ejection orifice row at the upstream front side (first row: ink ejection orifice row of the printing head K1). The fifth ink ejection orifice row numbered from the upstream side of the delivery (ink ejection orifice row of the printing head K5) ejects the ink onto the raster line zone L5 which is adjacent to the downstream side of the raster line zone L3 onto which the ink has been ejected from the third ink ejection orifice row (the ejection orifice row of the printing head K3). The sixth ink ejection orifice row numbered from the upstream side of the delivery (ink ejection orifice row of the printing head K6) ejects the ink onto the raster line zone L6 which is adjacent to the downstream side of the raster line zone L5 onto which the ink has been ejected from the fifth ink ejection orifice row (the ejection orifice row of the printing head K5). The fourth ink ejection orifice row numbered from the upstream side of the delivery (ink ejection orifice row of the printing head K4) ejects the ink onto the raster line zone L4 which is adjacent to the downstream side of the raster line zone L5 onto which the ink has been ejected from the sixth ink ejection orifice row. The second ink ejection orifice row numbered from the upstream side of the delivery (ink ejection orifice row of the printing head K2) ejects the ink onto the raster line zone L2 which is adjacent to the downstream side of the raster line zone L4 onto which the ink has been ejected from the fourth ink ejection orifice row (the ejection orifice row of the printing head K5). The first ink ejection orifice row numbered from the upstream side of the delivery (ink ejection orifice row of the printing head K1) ejects the ink onto the raster line zone L1 which is adjacent to the downstream side of the raster line zone L2 onto which the ink has been ejected from the second ink ejection orifice row.

As described above, the ink is ejected from predetermined printing heads for printing an image in raster line zones. In this embodiment, onto the raster line zone (L1), the ink is ejected from the ink ejection orifices of the first row from the upstream side (ink ejection orifice row of the printing head K1). Onto the raster line zones (L2 and L3) adjacent to the both sides of the raster line zone (L1), the ink is ejected from the ink ejection orifice rows of the printing head other than the rearmost printing head K6 on the downstream end side in the delivery direction. The positions of the impact of the ink droplets ejected from the two ink-ejection orifice rows at the upstream front side and the downstream end side can deviate relatively from the intended positions owing to errors in production working of the printer 10 or errors in recording medium delivery. However, such errors do not affect the printing since, onto the raster line zones adjacent to the raster line zone onto which ink has been ejected from the ink ejection orifice row on the upstream front side, the ink is not ejected from the ink ejection orifice rows on the downstream end side. Thereby, decline of the image quality (printing precision) caused by delivery error or a like error can be avoided.

Figure 9:
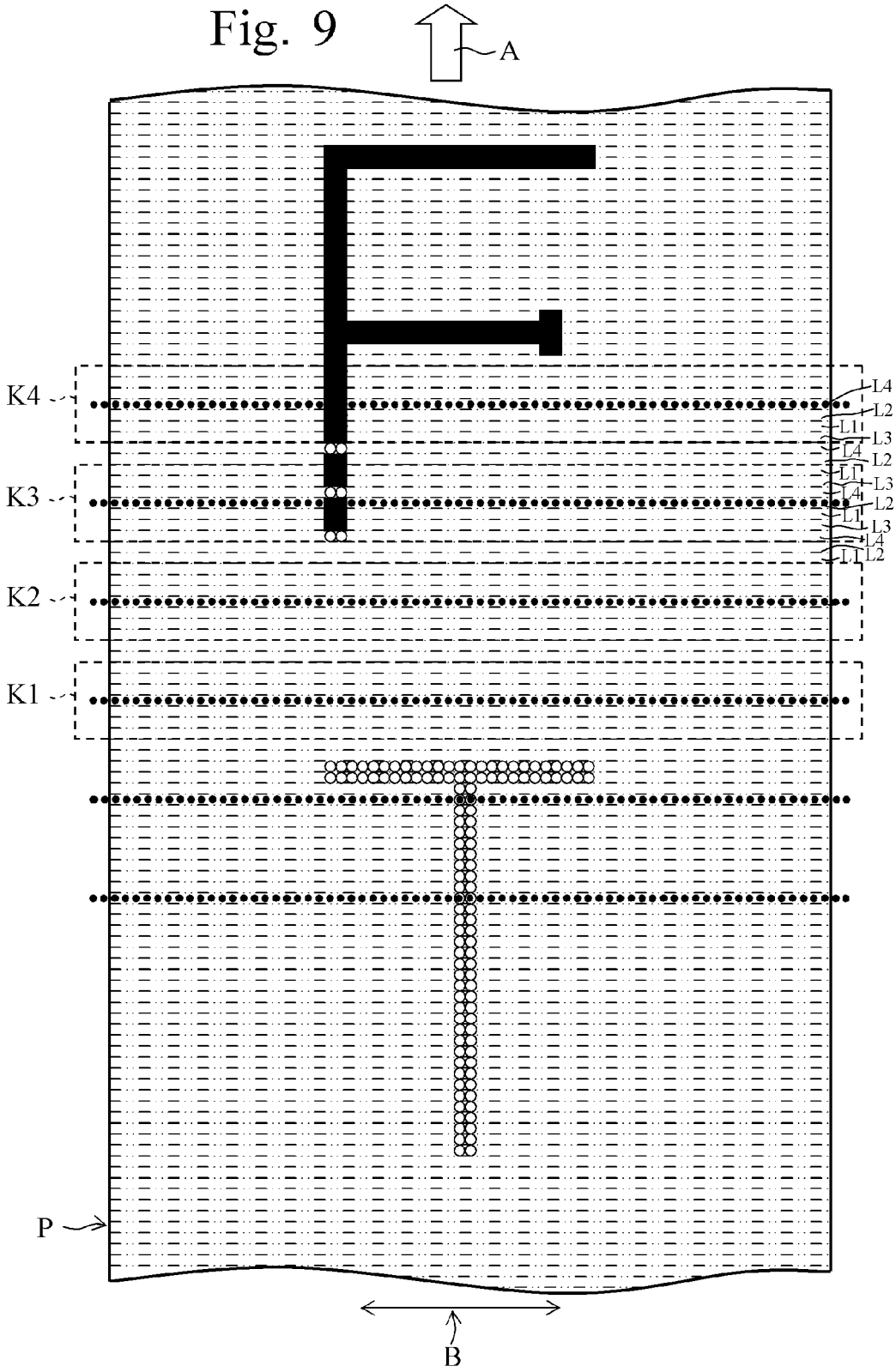
FIG. 9 illustrates schematically an intermediate state of formation of an image of characters "F" and "T" by four ink ejection orifice rows.
Figure 10:
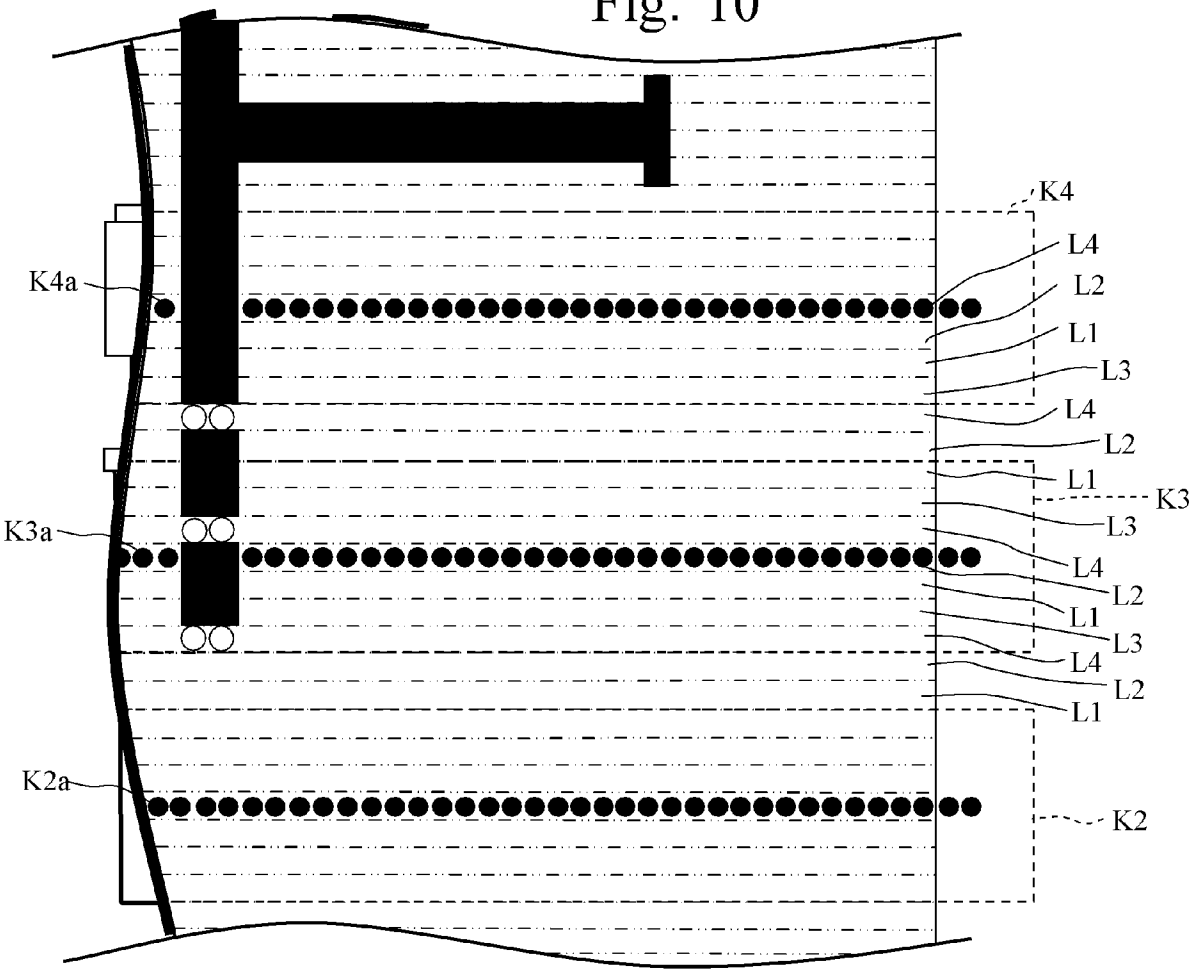
FIG. 10 is an enlarged view of a part of FIG. 9.

Another process of image formation is described in which four rows of ink ejection orifices are employed as illustrated in FIGS. 9 and 10.

FIG. 9 illustrates schematically an intermediate state of formation of an image of characters "F" and "T" with four ink-ejection orifice rows. FIG. 10 is an enlarged view of a part of FIG. 9.

The image "FT" is the same as that in FIG. 7. In this embodiment, the raster division is conducted by CPU 101 (FIG. 5) to form the image with four rows of ink ejection orifices. The raster divisions are input to the image memory 106 (FIG. 5) as the data for forming image with respective one of the four printing heads K1-K4. When the imaginary raster line zones L1-L4 have come to the position directly below the corresponding printing heads K1-K4, the ink is ejected from the ink ejection orifice rows.

In the state illustrated in FIG. 10, the raster line zone L4 is directly below the printing head K4 (ink ejection orifice row, hereafter the same), which allows the printing head K4 to eject the ink. However, in the state illustrated in FIG. 10, the raster line zone L2 is directly below the printing head K3, the raster line zone L1 is directly below the printing head K2, and the raster line zone L3 is directly below the printing head K1, so that the ink is not ejected from the printing heads K2, K3, and K4.

With the delivery of the recording medium P in the arrow-A direction, respective raster line zones reach successively the positions directly below the printing heads K1-K4. CPU 101 controls the printing head K1 to eject the ink from the selected ink ejection orifices of the ink ejection orifice row of the printing head K1 at the timing when the raster line zone L1 reaches the position directly below the printing head K1 in accordance with the image data. (The same is true with other printing heads.) As described above, in this embodiment, an image is formed by four rows of ink ejection orifices. In this case, the second row numbered from the upstream side of the four ink-ejection orifice rows (ink ejection orifice row of the printing head K2) in the delivery direction ejects the ink onto the raster line zone L2 which is adjacent to the downstream side of the raster line zone L1 onto which the ink has been ejected from the ejection orifice row (first row) at the upstream front side (ink ejection orifice row of the printing head K1). The fourth ink ejection orifice row numbered from the upstream side of the delivery (ink ejection orifice row of the printing head K4) ejects the ink onto the raster line zone L4 which is adjacent to the downstream side of the raster line zone L2 onto which the ink has been ejected from the second ink ejection orifice row. The third ink ejection orifice row numbered from the upstream side of the delivery (ink ejection orifice row of the printing head K3) ejects the ink onto the raster line zone L3 which is adjacent to the downstream side of the raster line zone L4 onto which the ink has been ejected from the fourth ink ejection orifice row (the ejection orifice row of the printing head K4). The first ink ejection orifice row numbered from the upstream side of the delivery (ink ejection orifice row of the printing head K1) ejects the ink onto the raster line zone L1 which is adjacent to the downstream side of the raster line zone L3 onto which the ink has been ejected from the third ink ejection orifice row.

The timing of ejection of the ink from the four printing heads of the above example is described with reference to FIGS. 11 and 12.

FIG. 11 is a schematic illustration of image data (raster divisions) in an image memory. FIG. 12 is a timing chart showing the timing of ejection of the ink from the four printing heads.

FIG. 11 illustrates schematically a part of image data memorized in an image memory 106 (FIG. 5) as raster divisions derived by CPU101 (FIG. 5): the entire image to be formed on the recording medium is memorized in the image memory 106 as divisions of the raster, like L1-1, L2-1, . . . L1-Fin, L2-Fin, L2-Fin, and L4-Fin. Here, the symbol "L1-1" denotes image data to be printed at the first ink ejection by the ink ejection orifice row of the printing head K1; "L4-2" denotes image data to be printed at the second ink ejection by the ink ejection orifice row of the printing head K4; "L4-(Fin-1)" denotes image data to be printed at the ink ejection before the final by the ink ejection orifice row of the printing head K4; "L1-(Fin)" denotes image data to be printed at the final ink ejection by the ink ejection orifice row of the printing head K1; and "L4-(Fin)" denotes image data to be printed at the final ink ejection by the ink ejection orifice row of the printing head K4 at the end of the printing.

The raster lines (image data) L1-1, L2-1, . . . L2-Fin, L4-Fin corresponding to the printing head K1-K4 are formed into an actual image by ejecting the ink droplets from K1-K4 at timing described later as shown in FIG. 12.

On the upstream side of the recording medium delivery direction, a front edge sensor (not shown in the drawing) is placed at a distance of 2 inches (1 inch: 2.54 cm) between the sensing position and the printing head K1 (more precisely the ink ejection orifice row). The adjacent printing heads (e.g., printing head K1 and printing head K2) are placed at intervals of 1 inch (precisely, distance between the ink ejection orifice rows of the printing heads K1 and K2). Each of the printing heads K1-K4 has ink ejection orifices (nozzles) at a pitch (resolution) of 600 [dots/inch], and has the maximum recording breadth (printing breadth) of 4 inches. Thus, each of the printing heads K1-K4 has 2400 ink-ejection orifices for the recording: one ink ejection orifice row has 2400 ink ejection orifices.

In this embodiment, the recording medium delivery speed (recording rate) is controlled to be 24 inches per second (about 610 mm/sec). The printing resolution in the recording medium delivery direction is adjusted to be 600 dots/inch. Accordingly, the image is formed with 600 raster lines per inch in the recording medium delivery direction: one raster line zone has a breadth (length in delivery direction) of 1/600 inch.

The encoder roller 47 (FIG. 1) connected to the delivery motor 41 (FIG. 1) outputs positional pulses at resolution, for example, of 150 pulses per inch of delivery path, namely one positional pulse for every four raster lines of printing. Therefore, at a delivery speed (recording rate) of 24 inch/sec, the encoder roller 47 outputs 3600 pulses per second in average.

This positional pulse is utilized as a trigger signal (print-starting signal) for each of the raster lines printed by the printing head K1 placed on the upstream front side of the printing heads in the delivery direction, and for the other three printing heads, K2, K3, and K4, the print-starting signals are transmitted with delay of 70 μsec, 139 μsec, and 208 μpsec, respectively from the above-mentioned positional pulse. The delay time is adjusted depending on the delivery speed.

The recording medium is delivered at a constant speed in the delivery direction (arrow-A direction in FIG. 1). The front edge of the recording medium is sensed by the aforementioned sensor. When the recording medium has been delivered by two inches more for forming a margin, the ink is ejected selectively from the ink ejection orifice row of the printing head K1 to form an image portion corresponding to L1-1 in FIG. 12 in a raster line zone (one L1 in FIG. 10). Then an image corresponding to L1-2 in FIG. 12 is formed on another raster line zone L1 (one L1 in FIG. 10) on the recording medium (L1, fourth zone upstream from the raster line zone L1 on which an image corresponding to L1-1 has been formed).

Figure 12:
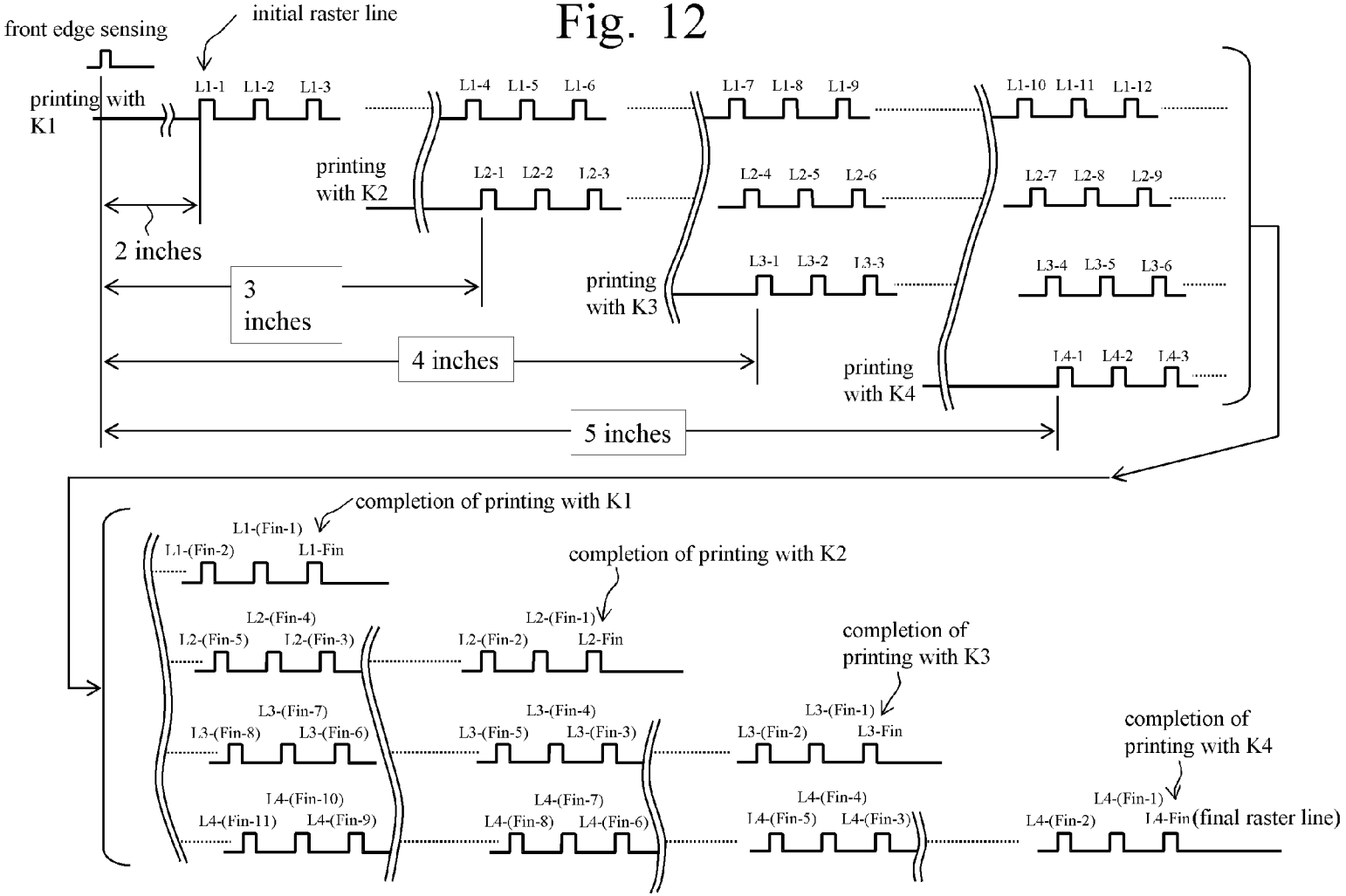
FIG. 12 is a timing chart showing the timing of ejection of the ink from the four printing heads.

Subsequently, an image corresponding to L1-3 in FIG. 12 is formed on one raster line zone (one L1 in FIG. 10) on the recording medium (L1, fourth zone upstream from the raster line zone L1 on which an image corresponding to L1-2 has been formed). In such a manner, the image comes to be formed (the printing proceeds) successively in the order of L1-1, L1-2, and L1-3 with intervals on the recording medium. With other printing heads K2-K4, the printing is conducted in the same manner as described later.

At the time when the recording medium has been delivered by one more inch (by 3 inches after detection of the front edge of the recording medium by the edge sensor), the printing with the printing head K2 is started to print the raster line L2-1 (the second raster line from the first raster line (L1-1)). Then the raster lines L2-2 and L2-3 are printed in this order with intervals in the same manner as the printing with the printing head K1. The intervals are the same as in printing with the printing head K1 (conducted below in the same manner). As illustrated in FIG. 11, the image of the raster line L2-1 is formed adjacently to the raster line L1-1 on the upstream side of the delivery: the image of the raster line L2-2 is formed adjacently to the raster line L1-2 on the upstream side of the delivery.

Further at the time when the recording medium has been delivered by one more inch (by 4 inches after detection of the front edge of the recording medium by the edge sensor), the printing with the printing head K3 is started to print the raster line L3-1 (the fourth raster line from the first raster line (L1-1) ). Then the raster lines L3-2 and L3-3 are printed with intervals. As illustrated in FIG. 11, the image of the raster line L3-1 is formed adjacently to the raster line L1-2 on the upstream side of the delivery: the image of the raster line L3-2 is formed adjacently to the raster line L1-3 on the upstream side of the delivery.

Further at the time when the recording medium has been delivered by one more inch (by 5 inches after detection of the front edge of the recording medium by the edge sensor), the printing with the printing head K4 is started to print the raster line L4-1 (the third raster line from the first raster line (L1-1) ). Then the raster lines L4-2 and L4-3 are printed with intervals. As illustrated in FIG. 11, the image of the raster line L4-1 is formed adjacently to the raster line L2-1 on the upstream side of the delivery: the image of the raster line L4-2 is formed adjacently to the raster line L2-2 on the upstream side of the delivery. Formation of a portion of a complete image is started when the ejection from the printing head K4 is started.

As described above, respective raster lines are formed successively on the recording medium being delivered. When the printing comes near to the end portion, the printing head K1 prints the raster line L1-(Fin-2) (eleventh raster line from the final raster line L4-Fin), the raster line L1-(Fin-1), and the raster line L1-Fin in this order to finish the printing by the printing head K1.

The printing is continued further. When the recording medium has been delivered by one inch after printing of the raster line L1-Fin, the printing head K2 prints the raster line L2-(Fin-2) (tenth raster line from the final raster line L4-Fin), the raster line L2-(Fin-1), and the raster line L2-Fin to finish the printing by the printing head K2.

When the recording medium has been delivered by one inch more, the printing head K3 prints the raster line L3-(Fin-2) (ninth raster line from the final raster line L4-Fin), the raster line L3-(Fin-1), and the raster line L3-Fin in this order to finish the printing by the printing head K3.

When the recording medium has been delivered by one inch more, the printing head K4 prints the raster line L4-(Fin-2) (eighth raster line from the final raster line L4-Fin), the raster line L4-(Fin-1), and the raster line L4-Fin to finish the printing by the printing head K4.

As described above, monochromatic image data spread in a continuous region are divided, for example, into raster lines for four black-color printing head, whereby the recording speed is increased to four times that with the single printing head of 6 inch/sec, namely 24 inches/sec. As a secondary effect, inherent characteristics in printing of the orifices of the printing heads K1-K4 are not continuous, and the recording is conducted separately for every four raster lines, so that the image quality can be improved remarkably. That is, the image quality can be made reliable regardless of incidental ejection failure.

In the above embodiment, an image raster is divided into raster divisions and the raster divisions are printed respectively with predetermined printing heads: onto the raster line zone (L1 in this example) onto which the ink is ejected from the ink ejection orifices of a front row in the delivery direction (K1 in this example), and the ink is not ejected onto the adjacent raster line zones on both sides thereof from the ink ejection orifices of the rearmost row in the delivery direction (orifice row of the printing head K4).

The points of the impact of the ink droplets ejected from the orifices of the two ink-ejection orifice rows at the upstream front side and the downstream end side of the printing heads can deviate from the predetermined positions owing to errors in production working of the printer 10 or errors in recording medium delivery. However, such errors do not affect the printing in the above embodiment since, onto the raster line zones adjacent to the raster line zone onto which ink has been ejected from the front ejection orifice row in the delivery direction, the ink is not ejected from the rear most ejection orifice rows in the delivery direction. Thereby, deterioration of the image quality (printing precision) caused by delivery error or a like error can be avoided.

Figure 13:
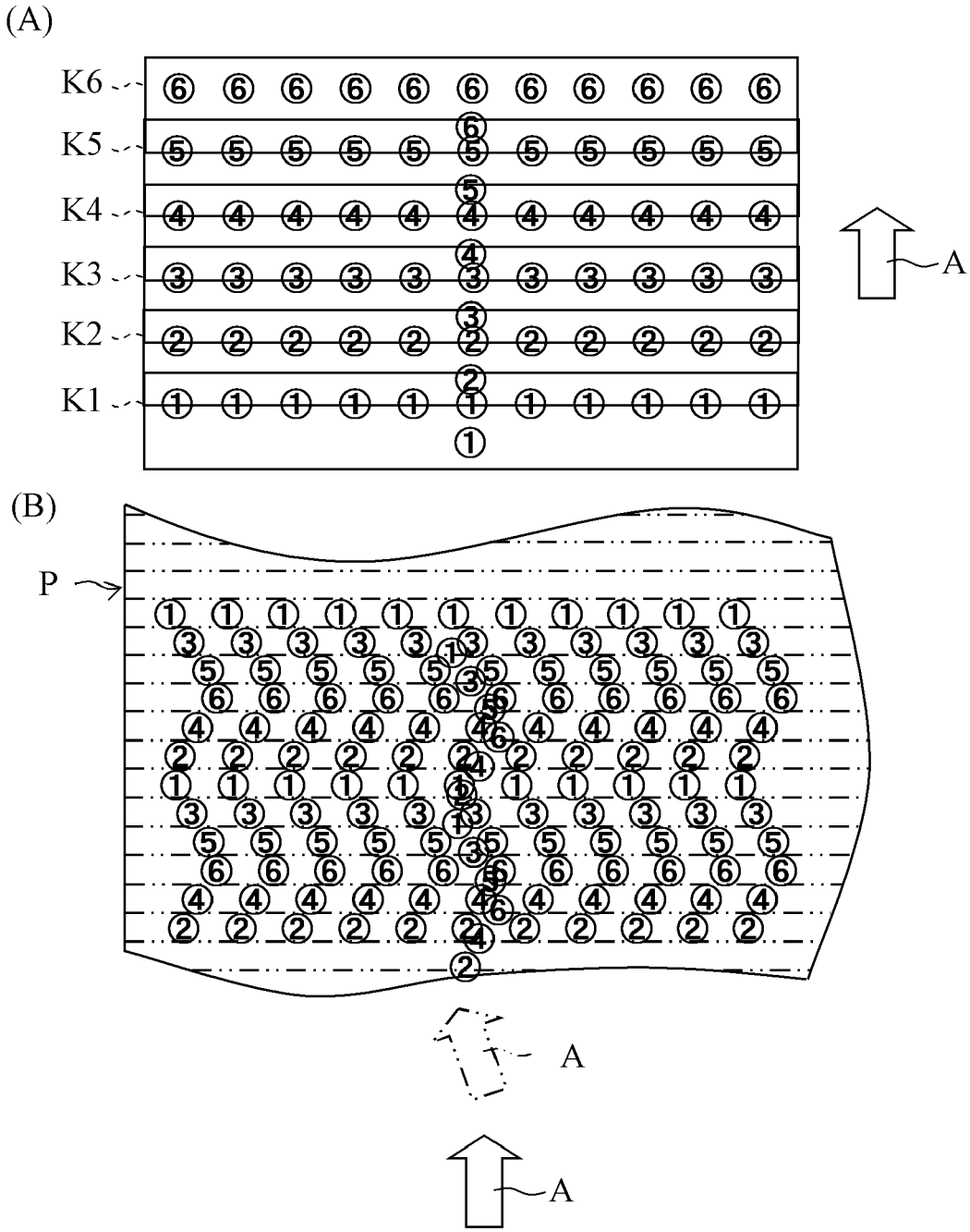
FIGS. 13A and 13B illustrate schematically an example of prevention of decline of image quality (printing precision) caused by an error in recording medium delivery.

An example is described for prevention of decline of the image quality (printing precision), caused by an error in delivery of the recording medium, with reference to FIGS. 13A and 13B.

FIGS. 13A and 13B illustrate schematically an example of prevention of drop of image quality (printing precision) caused by an error in delivery of the recording medium. FIG. 13A is a schematic view of six printing heads K1, K2, K3, K4, K5, and K6 placed in the delivery direction (arrow-A direction). FIG. 13B is a schematic view of a printed image which is prevented from decline of the image quality. In FIG. 13A, the numbered circle mark denotes the ink ejection orifice in a row of the printing head of that number. In FIG. 13B, the numbered circle mark denotes a picture element formed by the ink droplet ejected from the ink ejection orifice of the printing head of that number. The two-dot chain lines on the recording medium P denote the aforementioned raster line zone.

In FIGS. 13A and 13B, the recording medium P is delivered obliquely as indicated by the two-dot-line arrow mark A: The intended delivery direction is indicated by the full-line arrow mark A.

In FIGS. 13A and 13B, among the correctly arranged row of ink ejection orifices (denoted by the circles of numbers 1-6 in FIG. 13A), the orifices of the front row in the recording medium delivery direction (ink ejection orifice row of the printing head K1) eject respectively the ink onto one corresponding raster line zone (the zone on which picture elements of number-1 circles in FIG. 13B are dotted), whereas, onto the two raster line zones adjacent to the both sides of the above printed raster line zone, the ink is ejected from the orifices of a row other than the orifices of the rearmost row in the recording medium delivery direction (ink ejection orifice row of the printing head K6).

In the example shown in FIGS. 13A and 13B, one raster line zone is considered on which one of the ink ejection orifice rows (e.g., the ink ejection orifice row of printing head K6) of the six printing heads K1-K6 ejects the ink onto one raster line zone. Onto the two adjacent raster line zones on the both sides of the above printed raster line zone, the ink is ejected from an ejection orifice row adjacent to the above ink ejection orifice row (e.g., the ink ejection orifice row of the printing head K4 or K5). Otherwise, the ink may be ejected from another ink ejection orifice row (e.g., ink ejection orifice row of the printing head K3 or K4) adjacent on both sides to the above adjacent one row of the ink ejection orifice row (e.g., ink ejection orifice row of the printing head K6). Thereby the same effect can be achieved.

In other words, onto the plural raster line zones arranged orderly in the direction of recording medium delivery (arrow-A direction), ink is ejected from the corresponding ink ejection orifice rows (indicated by circled numbers 1-6). The ink is ejected onto one raster line zones from the odd-numbered rows (indicated by circled numbers 1, 3, and 5 in the delivery direction of the ink ejection orifice) in the number-ascending order. Onto the following raster line zones after the above raster line zones, the ink is ejected from the even-numbered rows (indicated by circled numbers 2, 4, and 6 in the delivery direction of the ink ejection orifice) in the number-descending order. Thereby the same effect as above can be achieved. Otherwise, the ink may be ejected from the odd-numbered ink ejection orifice rows (rows of circled numbers 1, 3, and 5) in a number-descending order, and from the even-numbered ink ejection orifice rows (rows of circled numbers 2, 4, and 6) in a number-ascending order. Accordingly, the present invention can minimize deviation between the adjacent raster line zones, even when the recording medium is delivered obliquely as shown in FIG. 13B to prevent indentation illustrated in FIGS. 16A and 16B not cause drop of the image quality.

Figure 14:
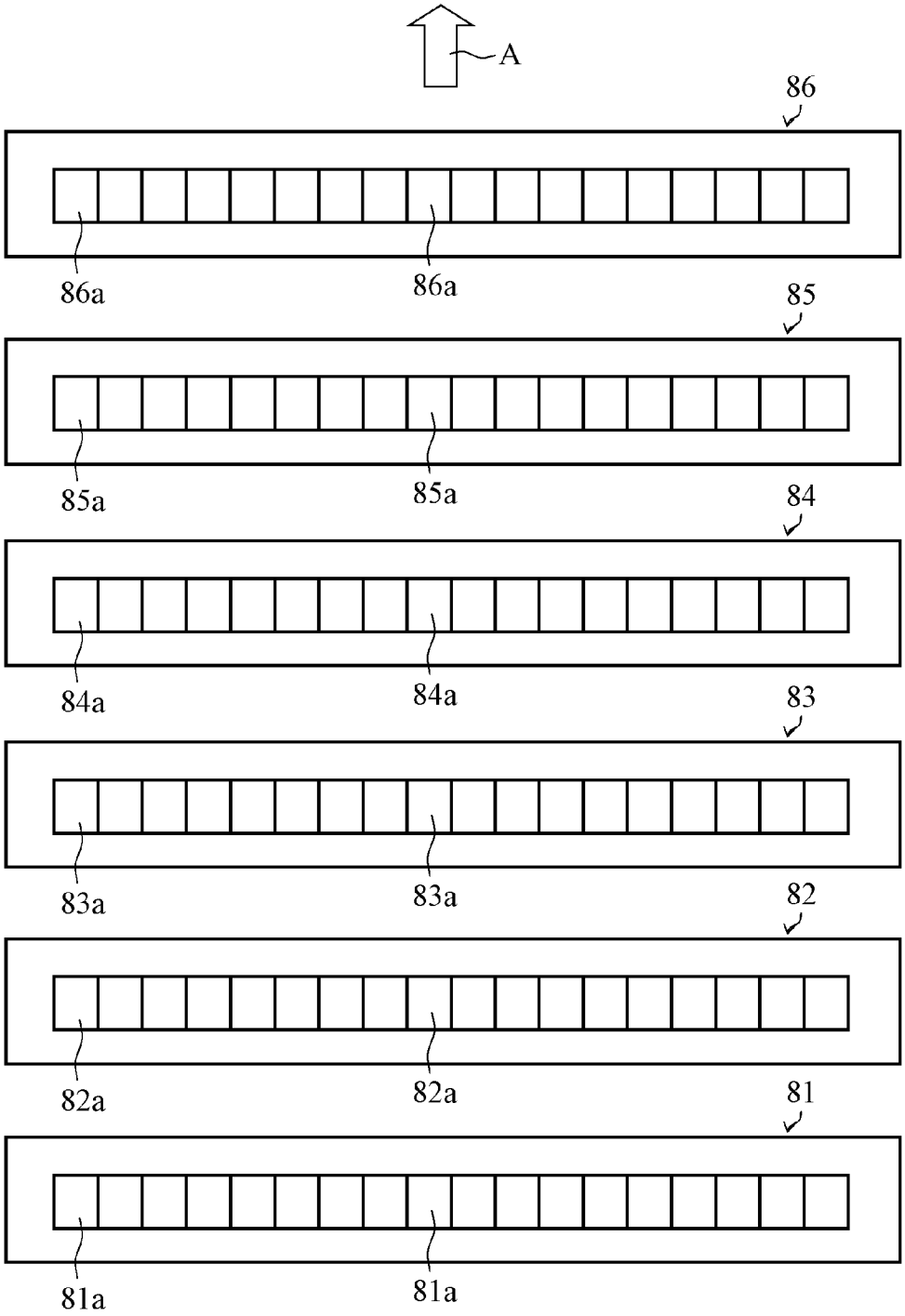
FIG. 14 illustrates schematically printing heads of a thermal transfer type of image-forming apparatus.
Figure 15:
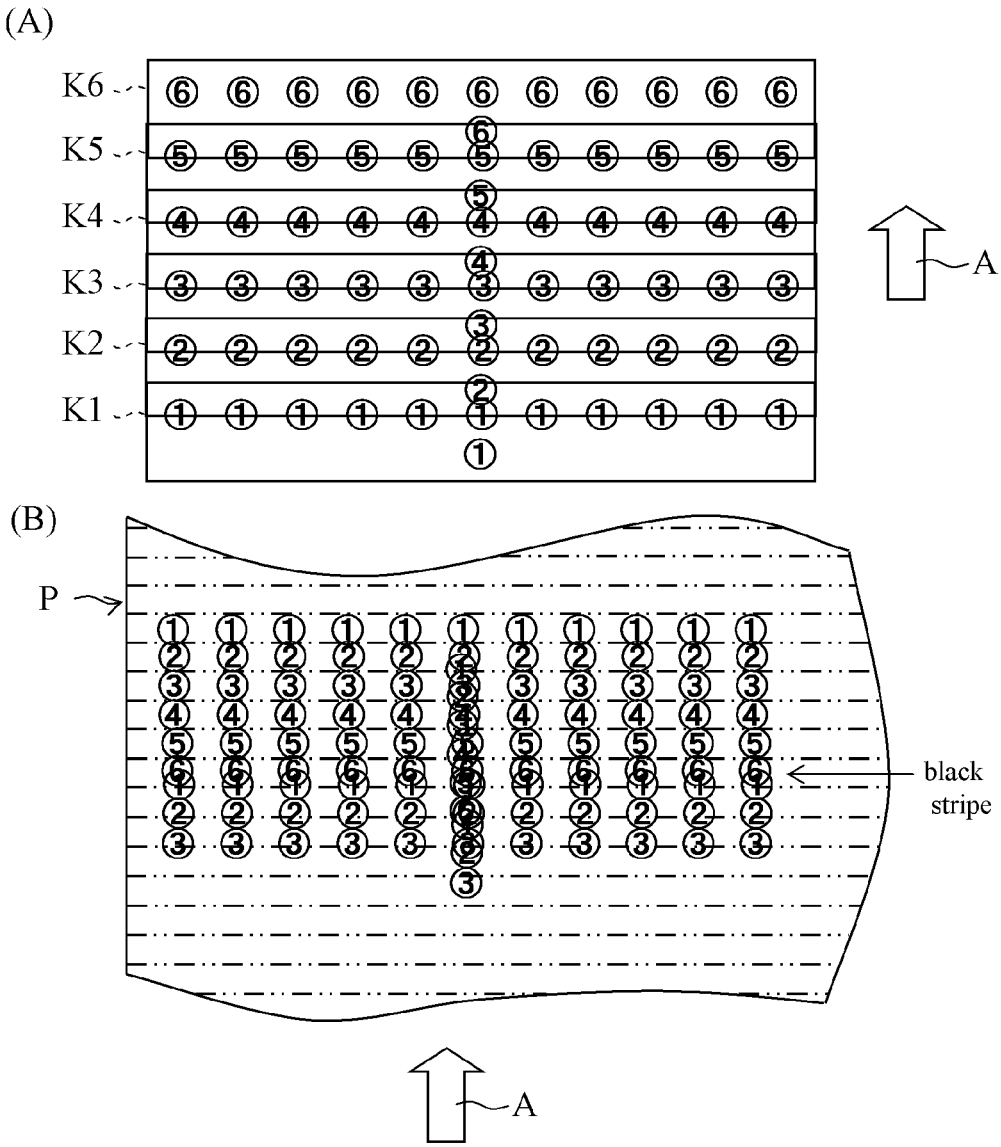
FIG. 15A illustrates schematically six printing heads K1, K2, K3, K4, K5, and K6 arranged in the recording medium delivery direction (arrow-A direction).
FIG. 15B illustrates schematically an image having a black stripe.
Figure 16:
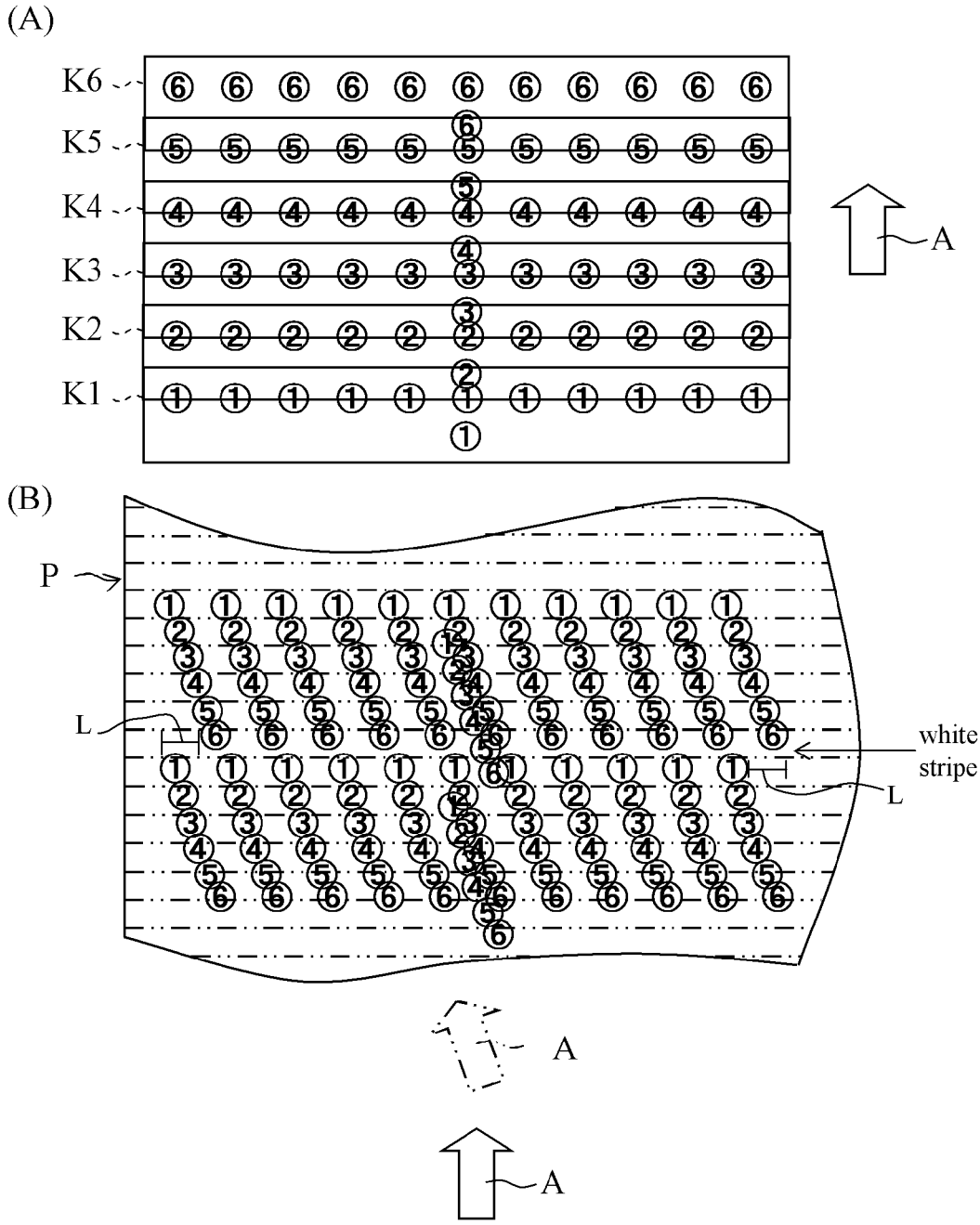
FIG. 16A illustrates schematically six printing heads K1, K2, K3, K4, K5, and K6 arranged in the recording medium delivery direction (arrow-A direction).
FIG. 16B illustrates schematically an image in which a white stripe and an indent are caused owing to oblique delivery of the recording medium.

The image-forming apparatus of thermal transfer type employing the image-forming method of the present invention is described below with reference to FIG. 14. FIG. 14 is a schematic view of a printing head of a thermal transfer type image-forming apparatus. A known thermal transfer type of image-forming apparatus (not shown in the drawing) has plural printing heads, for example six printing heads, 81,82, 83,84,85,86 arranged orderly in the recording medium delivery direction (arrow-A direction). The printing heads 81,82, 83,84,85,86 has respectively plural heater elements 81*a*,82*a*, 83*a*,845*a*,85*a*,86*a* arranged in the direction perpendicular to the recording medium delivery direction. Any of the heater elements 81*a*-86*a* are energized in accordance with the image information to allow the ink of an ink film to transfer onto the recording medium to form an image. The ink-jet type image-forming apparatus ejects ink selectively from plural ink ejection orifices, whereas the thermal transfer type image-forming apparatus energizes plural heater elements selectively. With the heat transfer type of image-forming apparatus also, the deviation between the adjacent raster line zones can be minimized by dividing the image data into raster divisions as described with reference to FIGS. 6-12 and energizing the heater elements 81*a*-86*a* of the respective printing heads 81-86, similarly as with the ink-jet type of image-forming apparatus even when the recording medium is delivered obliquely. As the results, a remarkable indent L as shown in FIG. 16 can be prevented not lower the image quality.

What is claimed is:

1. An image-forming method for forming an image on a recording medium by ejecting an ink successively through a row of ink ejection orifices selected from plural rows of ink ejection orifices arranged parallel perpendicularly to the delivery direction of the recording medium onto one of raster line zones constituted of plural picture element domains arranged, on the recording medium, parallel perpendicularly to the delivery direction of the recording medium, wherein, onto two raster line zones adjacent to both sides of the raster line zone onto which the ink is ejected from orifices of the front row of the ink ejection orifices in the delivery direction of the recording medium, the ink is ejected from rows of orifices other than the rearmost row of the ink ejection orifices in the delivery direction of the recording medium.

2. The image-forming method according to claim 1, wherein the same color ink is ejected from the plural rows of ink ejection orifices.

3. The image-forming method according to claim 2, wherein the ink ejection orifices are provided in plural rows on one printing head.

4. The image-forming method according to claim 2, wherein the rows of the ink ejection orifices are provided in a row respectively on separate printing heads.

5. The image-forming method according to claim 1, wherein the ink ejection orifices are provided in plural rows on one printing head.

6. The image-forming method according to claim 1, wherein the rows of the ink ejection orifices are provided in a row respectively on separate printing heads.

7. An image-forming method for forming an image on a recording medium by ejecting an ink successively through a row of ink ejection orifices selected from plural rows of ink ejection orifices arranged parallel perpendicularly to the delivery direction of the recording medium onto one of raster line zones constituted of plural picture element domains arranged, on the recording medium, parallel perpendicularly to the delivery direction of the recording medium, wherein, onto raster line zones adjacent to both sides of the raster line zone onto which the ink is ejected from orifices of the selected row of the ink ejection orifices, the ink is ejected from an ink ejection orifice row adjacent to the selected ink ejection orifice row, or from an ejection orifice row next to the ink-ejection orifice row adjacent to the selected ink ejection orifice row.

8. The image-forming method according to claim 7, wherein the same color ink is ejected from the plural rows of ink ejection orifices.

9. The image-forming method according to claim 7, wherein the ink ejection orifices are provided in plural rows on one printing head.

10. The image-forming method according to claim 7, wherein the rows of the ink ejection orifices are provided in a row respectively on separate printing heads.

11. An image-forming method for forming an image on a recording medium by ejecting an ink successively through a row of ink ejection orifices selected from plural rows of ink ejection orifices arranged parallel perpendicularly to the delivery direction of the recording medium onto one of raster line zones constituted of plural picture element domains arranged, on the recording medium, parallel perpendicularly to the delivery direction of the recording medium, wherein, the ink is ejected, onto the raster line zones arranged in the delivery direction, successively from the ink ejection orifices of the odd-numbered rows in the delivery direction in the number-ascending order, and onto the following raster line zones, the ink is ejected from the ink ejection orifices of the even-numbered rows in the delivery direction in the number-descending order.

12. The image-forming method according to claim 11, wherein the same color ink is ejected from the plural rows of ink ejection orifices.

13. The image-forming method according to claim 11, wherein the ink ejection orifices are provided in plural rows on one printing head.

14. The image-forming method according to claim 11, wherein the rows of the ink ejection orifices are provided in a row respectively on separate printing heads.

15. An image-forming method for forming an image on a recording medium by ejecting successively an ink through a row of ink ejection orifices selected from six ink ejection orifice rows arranged parallel perpendicularly to the delivery direction of the recording medium, onto one of raster line zones constituted of plural picture element domains arranged parallel perpendicularly to the delivery direction of the recording medium, comprising:

conducting simultaneously, ejection of the ink from the third row of the six ink ejection orifice rows numbered in the delivery direction onto an adjacent raster line zone next to the raster line zone onto which the ink is ejected from the front row (first row) numbered in the delivery direction of the ink ejection orifices;

ejection of the ink from the fifth row of the six ink ejection orifice rows numbered in the delivery direction onto an adjacent raster line zone next to the raster line zone onto which the ink is ejected from the third row numbered in the delivery direction of the ink ejection orifices;

ejection of the ink from the sixth row of the six ink ejection orifice rows numbered in the delivery direction onto an adjacent raster line zone next to the raster line zone onto which the ink is ejected from the fifth row numbered in the delivery direction of the ink ejection orifices;

ejection of the ink from the fourth row of the six ink ejection orifice rows numbered in the delivery direction onto an adjacent raster line zone next to the raster line zone onto which the ink is ejected from the sixth row numbered in the delivery direction of the ink ejection orifices;

ejection of the ink from the second row of the six ink ejection orifice rows numbered in the delivery direction onto an adjacent raster line zone next to the raster line zone onto which the ink is ejected from the fourth row numbered in the delivery direction of the ink ejection orifices; and ejection of the ink from the first row of the six ink ejection orifice rows numbered in the delivery direction onto an adjacent raster line zone next to the raster line zone onto which the ink is ejected from the second row numbered in the delivery direction of the ink ejection orifices.

16. The image-forming method according to claim 15, wherein the same color ink is ejected from the plural rows of ink ejection orifices.

17. The image-forming method according to claim 15, wherein the ink ejection orifices are provided in plural rows on one printing head.

18. The image-forming method according to claim 15, wherein the rows of the ink ejection orifices are provided in a row respectively on separate printing heads.

19. An image-forming method for forming an image on a recording medium by ejecting successively an ink through a row of ink ejection orifices selected from four ink ejection orifice rows arranged parallel perpendicularly to the delivery direction of the recording medium, onto one of raster line zones constituted of plural picture element domains arranged parallel perpendicularly to the delivery direction of the recording medium, comprising:

conducting simultaneously, ejection of the ink from the second row of the four ink ejection orifice rows numbered in the delivery direction onto an adjacent raster line zone next to the raster line zone onto which the ink is ejected from the front row (first row) numbered in the delivery direction of the ink ejection orifices;

ejection of the ink from the fourth row of the four ink ejection orifice rows numbered in the delivery direction onto an adjacent raster line zone next to the raster line zone onto which the ink is ejected from the second row numbered in the delivery direction of the ink ejection orifices;

ejection of the ink from the third row of the four ink ejection orifice rows numbered in the delivery direction onto an adjacent raster line zone next to the raster line zone onto which the ink is ejected from the fourth row numbered in the delivery direction of the ink ejection orifices; and ejection of the ink from the first row of the four ink ejection orifice rows numbered in the delivery direction onto an adjacent raster line zone next to the raster line zone onto which the ink is ejected from the third row numbered in the delivery direction of the ink ejection orifices.

20. The image-forming method according to claim 19, wherein the same color ink is ejected from the plural rows of ink ejection orifices.

21. The image-forming method according to claim 19, wherein the ink ejection orifices are provided in plural rows on one printing head.

22. The image-forming method according to claim 19, wherein the rows of the ink ejection orifices are provided in a row respectively on separate printing heads.

23. An image-forming method for forming an image on a recording medium by forming successively a portion of an image, with a row of image-forming elements selected from plural rows of image-forming elements arranged parallel perpendicularly to a delivery direction of the recording medium, on one of raster line zones constituted of plural picture element domains arranged, on the recording medium, parallel perpendicularly to the delivery direction of the recording medium, wherein, on two raster line zones adjacent to both sides of the raster line zone onto which the a portion of the image is formed by a front row of the image-forming elements in the delivery direction of the recording medium, the portion of the image is formed by a row of the image-forming elements other than the rearmost row of the image-forming elements in the delivery direction.

24. An image-forming apparatus having plural rows of image-forming elements for forming an image on a recording medium, arranged parallel perpendicularly to the delivery direction of the recording medium, successively a portion of an image with a row of the image-forming elements selected from the plural rows of image-forming elements arranged parallel perpendicularly to the delivery direction of the recording medium, on one of raster line zones constituted of plural picture element domains arranged, on the recording medium, parallel perpendicularly to the delivery direction of the recording medium, wherein, the apparatus forms the portion of the image onto two raster line zones adjacent to both sides of the raster line zone onto which the a portion of the image is formed by a front row of the image-forming elements in the delivery direction of the recording medium, by a row of the image-forming elements other than the rearmost row of the image-forming elements in the delivery direction of the recording medium.

25. An image-forming method for forming a raster- line image on a recording medium, by employing ink ejection orifices arranged in a direction crossing the recording medium delivery direction in plural rows, which rows are laid along the recording medium delivery direction, by ejecting an ink from the respective rows of ink ejection orifices, wherein a zone onto which the ink is ejected from the most upstream-side row of the ejection orifices and a zone onto which the ink is ejected from the most downstream-side row of the ejection orifices are isolated from each other.

26. An image-forming method for forming a raster- line image on a recording medium, by employing ink ejection orifices arranged in a direction crossing the recording medium delivery direction in plural rows, which rows are laid along the recording medium delivery direction, by ejecting an ink from the respective rows of ink ejection orifices, wherein, onto a zone next to a first zone onto which the ink is ejected from a first row of the ink ejection orifices, the ink is ejected from a second row of the ink ejection orifices adjacent to the first row of the ejection orifices or from a third row of the ink ejection orifices adjacent further to the second row of the ink ejection orifices.

* * * * *